US010851971B1

(12) United States Patent
Huang et al.

(10) Patent No.: US 10,851,971 B1
(45) Date of Patent: Dec. 1, 2020

(54) ADJUSTABLE LIGHT FIXTURES

(71) Applicant: SIGNIFY HOLDING B.V., Eindhoven (NL)

(72) Inventors: Rongxiu Huang, Shanghai (CN); Jared Davis, Newnan, GA (US); Steven Pyshos, Boca Raton, FL (US)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/792,763

(22) Filed: Feb. 17, 2020

(51) Int. Cl.

| | |
|---|---|
| ***F21V 14/02*** | (2006.01) |
| ***F21S 8/02*** | (2006.01) |
| ***F21V 31/00*** | (2006.01) |
| ***F21V 21/04*** | (2006.01) |
| *F21Y 115/10* | (2016.01) |

(52) U.S. Cl.
CPC ..... *F21V 14/02* (2013.01); *F21S 8/02* (2013.01); *F21V 21/04* (2013.01); *F21V 31/005* (2013.01); *F21Y 2115/10* (2016.08)

(58) Field of Classification Search
CPC ..... F21V 14/02; F21V 31/005; F21V 21/04; F21S 8/02; F21Y 2115/10
See application file for complete search history.

(56) References Cited

U.S. PATENT DOCUMENTS 2,971,670 A * 2/1961 McCormack ..... F21V 17/107 362/374
4,232,361 A * 11/1980 Kelsall ..... F21S 8/026 362/269
6,779,908 B1 8/2004 Ng
8,550,669 B2 10/2013 Macwan et al.
8,696,158 B2 4/2014 Santiago
2004/0008510 A1* 1/2004 Mah ..... H02J 7/025 362/192
2004/0213005 A1* 10/2004 Kohlmeier-Beckmann ..... B60Q 3/44 362/471
2011/0012535 A1* 1/2011 West ..... F21L 4/005 315/307
2012/0320577 A1* 12/2012 Wang ..... F21V 17/002 362/235
2013/0223067 A1* 8/2013 Ito ..... F21V 11/06 362/235
2014/0168968 A1* 6/2014 Streppel ..... F21V 7/0091 362/235
2015/0219317 A1* 8/2015 Littman Gatof ..... F21V 21/30 362/372
2015/0241027 A1* 8/2015 Zhang ..... F21V 7/0033 362/300

(Continued)

*Primary Examiner* — Donald L Raleigh

(57) ABSTRACT

An adjustable light fixture can include a housing having at least one wall that forms a first cavity, wherein in the housing has a top portion and a bottom end. The fixture can also further include a body having a first body portion and a second body portion, where the body is movably disposed within the first cavity of the housing, where the body is configured to have a plurality of positions relative to the housing. The adjustable light fixture can also include a resilient device disposed between the first body portion and the second body portion to simultaneously push the first body portion against the top portion of the housing and the second body portion against the bottom end of the housing when the body is in each of the positions relative to the housing.

20 Claims, 15 Drawing Sheets

(56) References Cited

U.S. PATENT DOCUMENTS

| | | | | |
|---|---|---|---|---|
| 2015/0308662 | A1* | 10/2015 | Vice | F21V 21/30 362/282 |
| 2017/0051903 | A1* | 2/2017 | Maglica | F21V 23/0492 |
| 2017/0284643 | A1* | 10/2017 | Coakley | F21V 21/04 |
| 2017/0363275 | A1* | 12/2017 | Hung | F21K 9/23 |
| 2018/0356056 | A1* | 12/2018 | Phillips | F21V 17/164 |
| 2019/0360668 | A1* | 11/2019 | Ernst | F21K 9/68 |
| 2020/0116340 | A1* | 4/2020 | Nikooyan | F21V 29/76 |

* cited by examiner

ADJUSTABLE LIGHT FIXTURES

TECHNICAL FIELD

Embodiments described herein relate generally to light fixtures, and more particularly to systems, methods, and devices for adjustable light fixtures.

BACKGROUND

Light fixtures can have a number of different shapes, sizes, configurations, and light sources. For example, low profile light fixtures can sometimes be adjustable. However, difficulties can arise when adjustable light fixtures are required to meet certain standards in order to be located in certain environments.

SUMMARY

In general, in one aspect, the disclosure relates to an adjustable light fixture. The adjustable light fixture can include a housing comprising at least one wall that forms a first cavity, where in the housing has a top portion and a bottom end. The adjustable light fixture can also include a body having a first body portion and a second body portion that movably abuts against the first body portion, where the body is movably disposed within the first cavity of the housing, where the body is configured to have multiple positions relative to the housing, where the positions includes the body having a tilt angle relative to the housing. The adjustable light fixture can further include a resilient device disposed between the first body portion and the second body portion, where the resilient device simultaneously pushes the first body portion against the top portion of the housing and the second body portion against the bottom end of the housing when the body is in each of the positions.

These and other aspects, objects, features, and embodiments will be apparent from the following description and the appended claims.

BRIEF DESCRIPTION OF THE DRAWINGS

The drawings illustrate only example embodiments of adjustable light fixtures and are therefore not to be considered limiting of its scope, as adjustable light fixtures may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements.

DETAILED DESCRIPTION OF EXAMPLE EMBODIMENTS

Figure 1A:
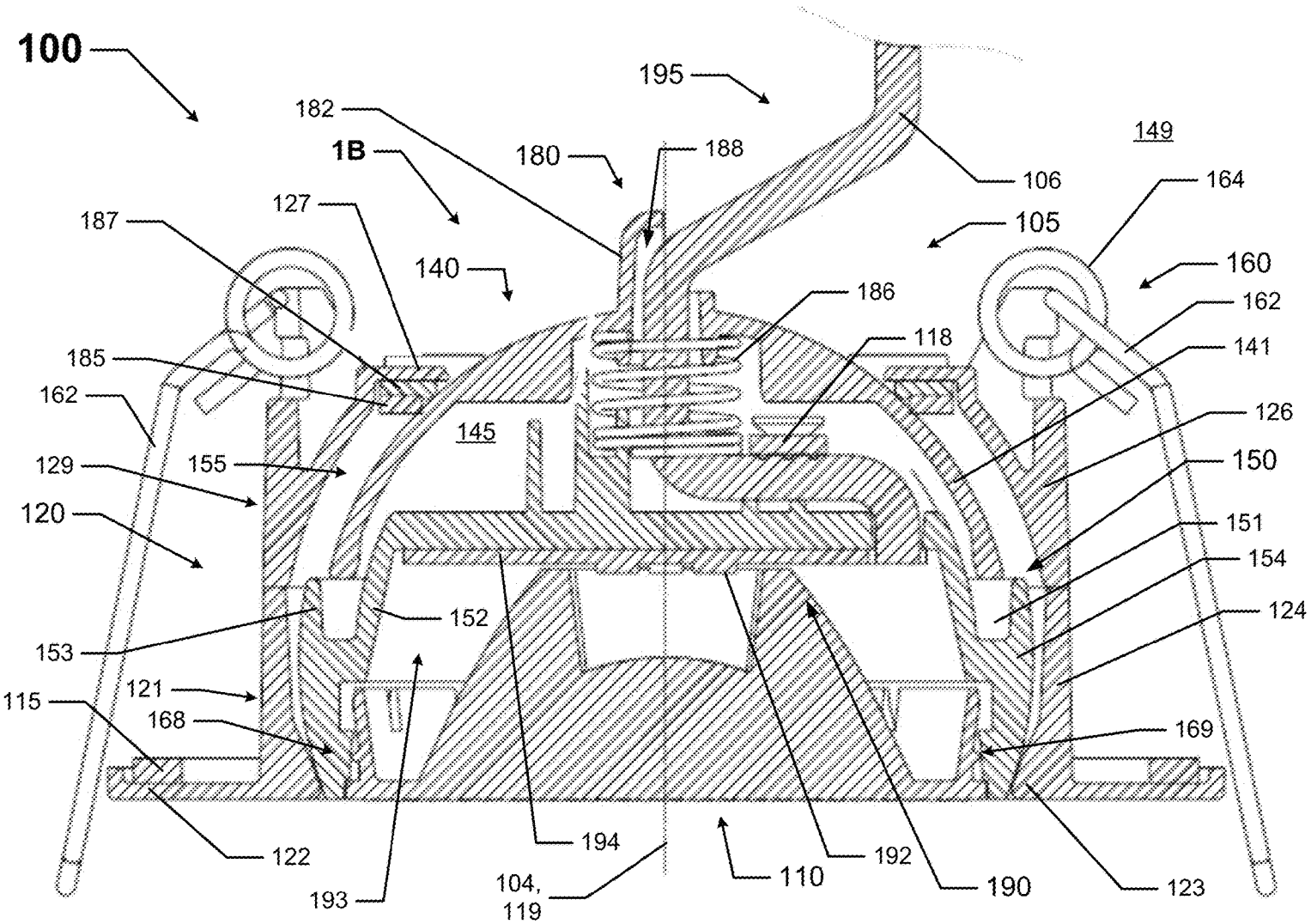
FIGS. 1A through 1C show various views of an adjustable light fixture in a nominal position in accordance with certain example embodiments.

The example embodiments discussed herein are directed to systems, methods, and devices for adjustable light fixtures (also more generally called luminaires herein). Example embodiments can be used with any type of light fixture. Further, example embodiments can be located in any environment (e.g., indoor, outdoor, high humidity, low temperature, sterile, high vibration). Further, adjustable light fixtures described herein can use one or more of a number of different types of light sources, including but not limited to light-emitting diode (LED) light sources, organic LEDs, fluorescent light sources, organic LED light sources, incandescent light sources, and halogen light sources. Therefore, light fixtures described herein should not be considered limited to a particular type of light source. When an adjustable light fixture uses LED light sources, those LED light sources can include any type of LED technology, including, but not limited to, chip on board (COB) and discrete die.

A user may be any person that interacts with an example adjustable light fixture. Examples of a user may include, but are not limited to, a homeowner, a tenant, a landlord, a property manager, an engineer, an electrician, an instrumentation and controls technician, a mechanic, an operator, a consultant, a contractor, an asset, a network manager, and a manufacturer's representative. Example adjustable light fixtures (including components thereof) described herein can be made of one or more of a number of materials, including but not limited to plastic, thermoplastic, copper, aluminum, rubber, stainless steel, and ceramic.

In certain example embodiments, example adjustable light fixtures are subject to meeting certain standards and/or requirements. For example, the National Electric Code (NEC), the National Electrical Manufacturers Association (NEMA), the International Electrotechnical Commission (IEC), the Federal Communication Commission (FCC), the California Energy Commission (CEC), and the Institute of Electrical and Electronics Engineers (IEEE) set standards as to electrical enclosures (e.g., light fixtures), wiring, and electrical connections. As another example, Underwriters Laboratories (UL) sets various standards for light fixtures, including standards for wet locations and air-tight ratings. Use of example embodiments described herein can meet such standards when required.

Any example adjustable light fixtures, or components thereof (e.g., example housings and bodies), described herein can be made from a single piece (e.g., as from a mold, injection mold, die cast, 3-D printing process, extrusion process, stamping process, or other prototype methods). In addition, or in the alternative, an example adjustable light fixture (or components thereof) can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, tabs, and slotted fittings. One or more pieces that are mechanically coupled to each other can be coupled to each other in one or more of a number of ways, including but not limited to fixedly, hingedly, removeably, slidably, and threadably.

Components and/or features described herein can include elements that are described as coupling, fastening, securing, abutting, or other similar terms. Such terms are merely meant to distinguish various elements and/or features within a component or device and are not meant to limit the capability or function of that particular element and/or feature. For example, a feature described as a "coupling feature" can couple, secure, fasten, abut, and/or perform other functions aside from merely coupling.

A coupling feature (including a complementary coupling feature) as described herein can allow one or more components and/or portions of an example adjustable light fixture to become coupled, directly or indirectly, to another portion of the light fixture and/or a component (e.g., a ceiling, an electrical cable) external to the light fixture. A coupling feature can include, but is not limited to, a snap, a clamp, a portion of a hinge, an aperture, a recessed area, a protrusion, a slot, a spring clip, a tab, a detent, and mating threads. One portion of an example adjustable light fixture can be coupled to another component of the light fixture by the direct use of one or more coupling features.

In addition, or in the alternative, a portion of an example adjustable light fixture can be coupled to another component of the light fixture using one or more independent devices that interact with one or more coupling features disposed on a component of the light fixture. Examples of such devices can include, but are not limited to, a pin, a hinge, a fastening device (e.g., a bolt, a screw, a rivet), epoxy, a sealing member (e.g., an O-ring, a gasket), glue, adhesive, tape, and a spring. One coupling feature described herein can be the same as, or different than, one or more other coupling features described herein. A complementary coupling feature (also sometimes called a corresponding coupling feature) as described herein can be a coupling feature that mechanically couples, directly or indirectly, with another coupling feature.

If a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure. The numbering scheme for the various components in the figures herein is such that each component is a three-digit number or a four-digit number, and corresponding components in other figures have the identical last two digits. For any figure shown and described herein, one or more of the components may be omitted, added, repeated, and/or substituted. Accordingly, embodiments shown in a particular figure should not be considered limited to the specific arrangements of components shown in such figure.

Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

Example embodiments of adjustable light fixtures will be described more fully hereinafter with reference to the accompanying drawings, in which example embodiments of adjustable light fixtures are shown. Adjustable light fixtures may, however, be embodied in many different forms and should not be construed as limited to the example embodiments set forth herein. Rather, these example embodiments are provided so that this disclosure will be thorough and complete, and will fully convey the scope of adjustable light fixtures to those or ordinary skill in the art. Like, but not necessarily the same, elements (also sometimes called components) in the various figures are denoted by like reference numerals for consistency.

Terms such as "first", "second", "top", "bottom", "lower", "upper", "side", "front", "distal", "proximal", "upward", "downward", and "within" are used merely to distinguish one component (or part of a component or state of a component) from another. Such terms are not meant to denote a preference or a particular orientation. Such terms are not meant to limit embodiments of adjustable light fixtures. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Figure 1B:
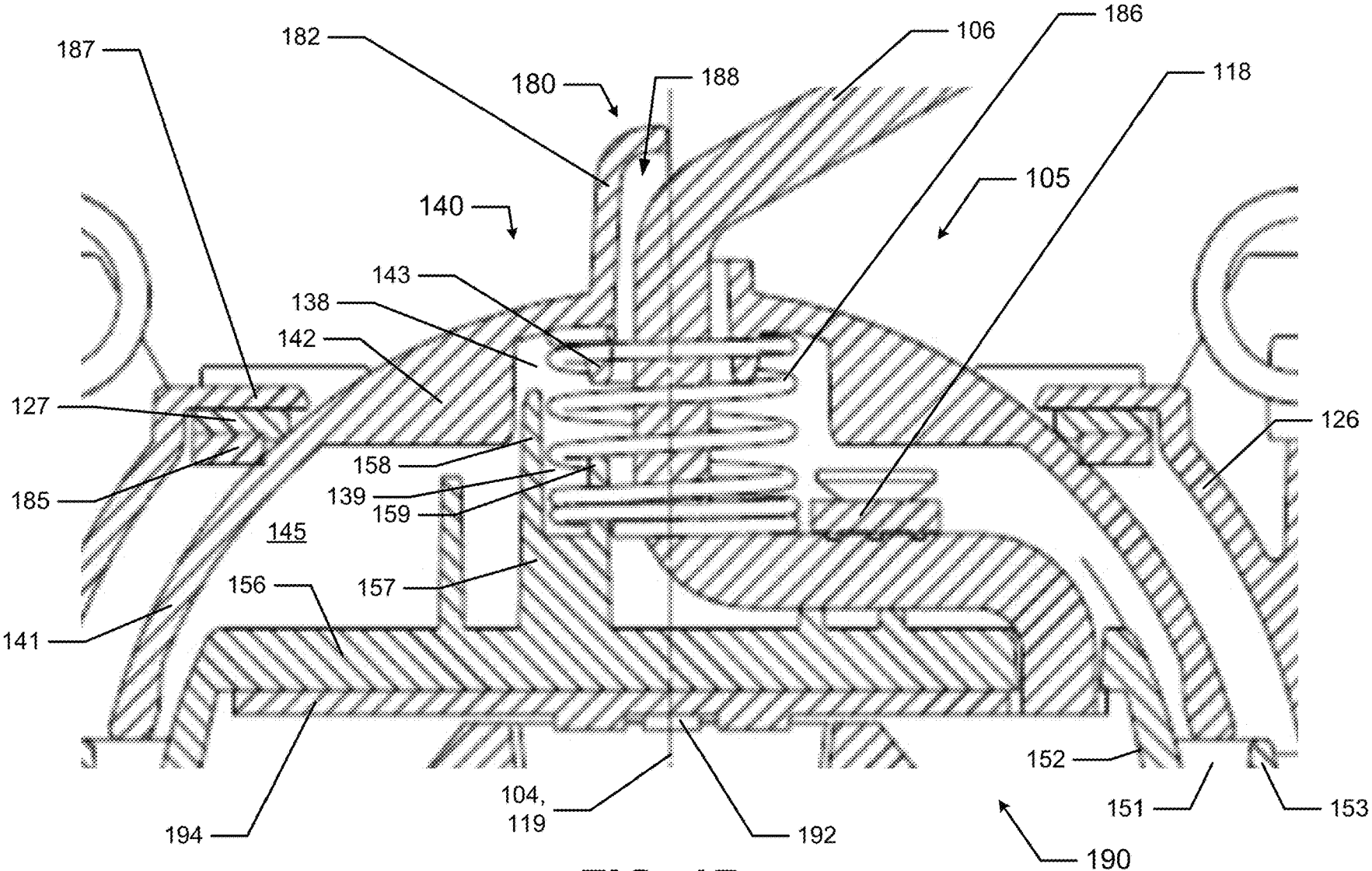
Figure 1C:
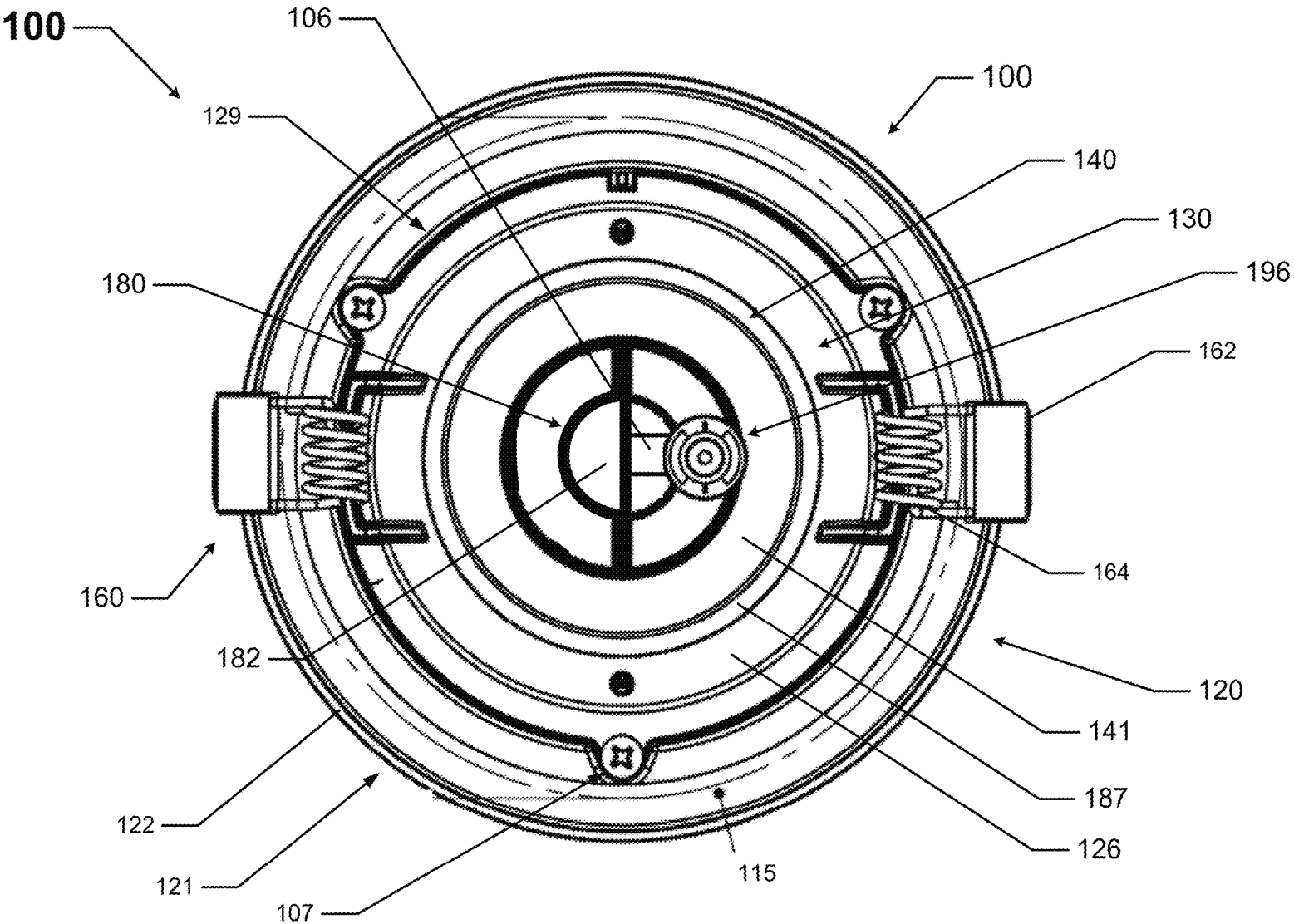

FIGS. 1A through 1C show various views of an adjustable light fixture 100 in a nominal position in accordance with certain example embodiments. Specifically, FIG. 1A shows a cross-sectional side view of the adjustable light fixture 100. FIG. 1B shows a cross-sectional side view of a detail of the adjustable light fixture 100. FIG. 1C shows a top view of the adjustable light fixture 100.

The example adjustable light fixture 100 of FIGS. 1A through 1C can include a number of different components. For example, in this case, adjustable light fixture 100 includes one or more electrical cables 106, where each electrical cable 106 has one or more electrical conductors. Further, each electrical cable 106 can have one or more coupling features 196 (e.g., an electrical connector end) that can couple to one or more components (e.g., a circuit board 194) of the adjustable light fixture 100 and/or another component (e.g., a junction box, another cable assembly) of a light fixture assembly. An example of this is shown below with respect to FIG. 7.

As another example, the adjustable light fixture 100 includes a housing 120, a body 105 (sometimes referred to as a gimbal), at least one sealing member 185, one or more optional friction blocks 187, and one or more coupling features 160. Similarly, one or more of these components of the adjustable light fixture 100 can have one or more of its own components or portions. For example, in this case, the housing 120 can have a first (e.g., upper) portion 129 and a second (e.g., lower) portion 121. As another example, as shown in FIGS. 1A and 1B, the body 105 can include a first (e.g., upper) portion 140 and a second (e.g., lower) portion 150, an optical assembly 110, a mechanical stop 180, and a light source assembly 190.

In certain example embodiments, the housing 120 of the adjustable light fixture 100 includes at least one wall (e.g., wall 124, wall 126, wall 127) that forms at least one cavity. In this case, the walls of the housing 120 form a single cavity 155 in which the body 105 and the sealing member 185 are disposed. The shape and size of the cavity 155 can be designed to perform multiple functions. First, the shape and size of the cavity 155 can be configured to receive and retain the body 105 of the adjustable light fixture 100 while allowing the body 105 to move within a range of positions while disposed in the cavity 155.

Figure 2:
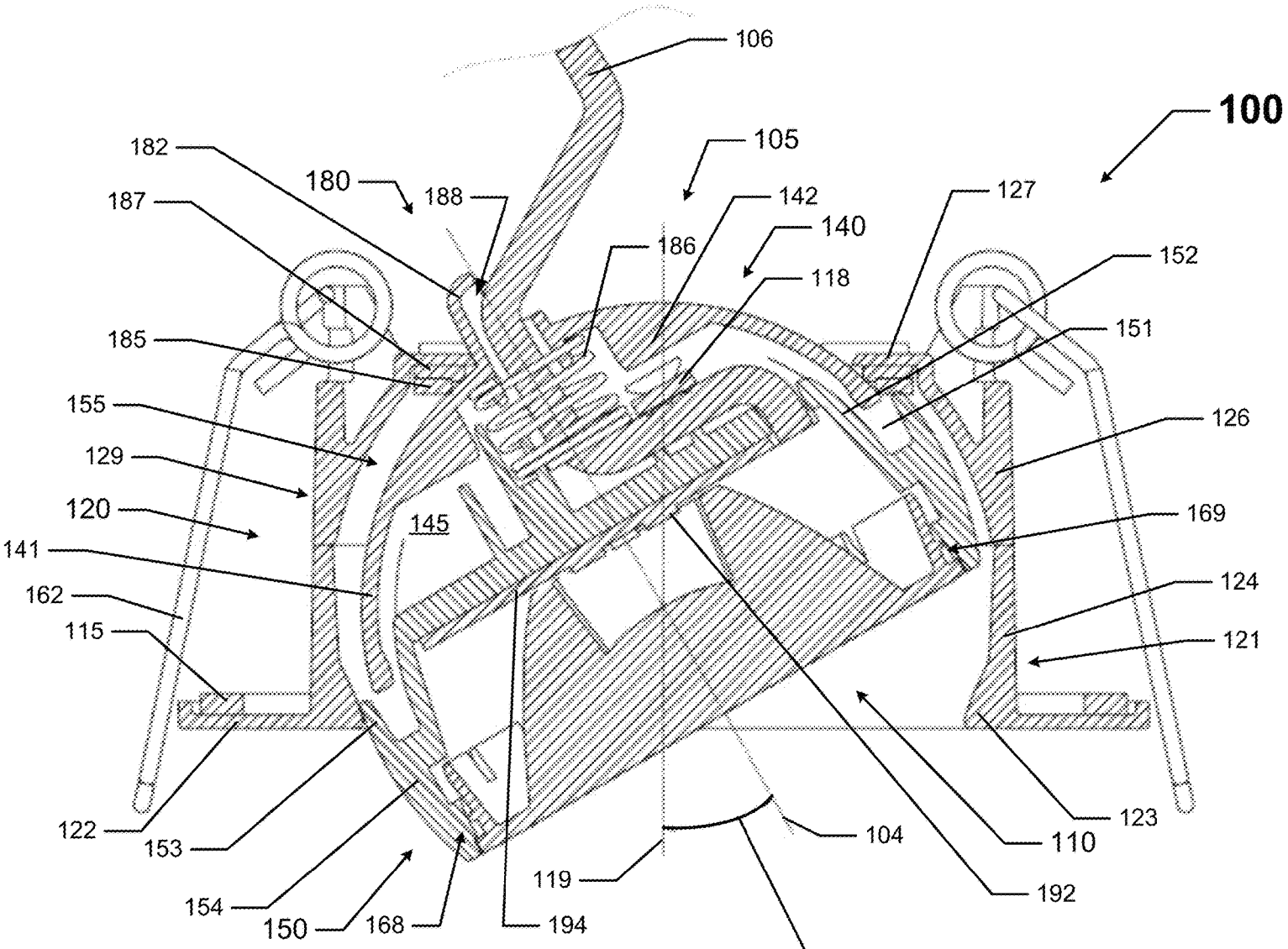
FIG. 2 shows a cross-sectional side view the adjustable light fixture of FIGS. 1A and 1B in a tilted position in accordance with certain example embodiments.

In FIGS. 1A through 1C, the body 105 is shown in a nominal position (i.e., pointing straight down, so that the bottom surface of the body 105 is parallel with the bottom end 123 of the housing 120, and so that the central axis 104 of the body 105 and the central axis 119 of the housing 120 are aligned or in parallel with each other). However, as shown in FIG. 2, the body 105 can also have an angle of tilt in any direction, and the cavity 155 of the housing 120 can be shaped and sized to accommodate all of these positions of the body 105. One way that this can be accomplished is to have the bottom end 123 of the portion 121 of the housing 120 tapered inward, narrowing the opening of the cavity 155 at the bottom of the housing 120 relative to, for example, the middle (in terms of height) of the cavity 155.

In some cases, the housing 120 can be made of a single piece. Alternatively, as stated above, the housing 120 can include multiple portions that are coupled to each other. In this example, the housing 120 has the upper portion 129 and the lower portion 121 that are coupled to each other. The multiple portions of the housing 120 can be coupled to each other, directly or indirectly, using any of a number of coupling features 107 (e.g., screws, mating threads, tabs, detents). In this example, as shown in FIG. 1C, portion 121 and portion 129 of the housing are coupled to each other using coupling features 107 in the form of screws disposed in threaded apertures in portion 121 and portion 129.

The optional sealing member 185 can be any device or component that acts as a barrier to prevent fluids (e.g., liquid, air) from passing therethrough. In this case, the sealing member 185 of the adjustable light fixture 100 can be one or more components that are designed to create a seal between the ambient environment 149 on one side of the sealing member 185 and a protected environment (e.g., part of cavity 155) on the other side of the sealing member 185. The seal or barrier created by the sealing member 185 can be configured to keep water, dust, and other contaminants from the ambient environment 149 from getting into the protected environment. The sealing member 185 in this case is coupled to the inner surface of the portion 129 of the housing 120 and abuts against the outer surface of the upper portion 140 of the body 105, regardless of the position of the body 105 relative to the housing 120.

The sealing member 185 can be somewhat malleable so that a seal can be maintained when the sealing member 185 abuts against another component (e.g., portion 140 of the body 105) of the adjustable light fixture 100. In addition to acting as a barrier between the ambient environment 149 and the protected environment, the sealing member 185 can perform one or more of a number of other functions. For example, the sealing member 185 can be made of a material (e.g., rubber) that has a relatively high coefficient of friction so that, by abutting against the outer surface of the body 105 (or portion thereof, such as portion 140), the sealing member 185 can maintain the position of the body 105 relative to the housing 120 until a user applies a sufficient force to overcome the frictional force applied to the body 105 by the sealing member 185 to move the body 105 to a new position relative to the housing 120. When the body 150 comes to rest in the new position, the sealing member 185 can apply its frictional force to the body 105 to maintain the body 105 in the new position relative to the housing 120.

The sealing member 185 can have any of a number of configurations and can be made of one or more of any number of materials. For example, the sealing member 185 can be a rubber gasket. As another example, the sealing member 185 can be a nylon O-ring. As yet another example, the sealing member 185 can include a rubber gasket with a metal band clamped over the outer perimeter of the rubber gasket, where the metal band is wedged into a channel formed on the inner surface of one or more walls of the housing 120 (or portion thereof).

Disposed along an inner surface of one or more walls of the housing 120 (in this case, portion 129 of the housing 120) can be a channel inside of which the one or more sealing members 185 can be disposed. One or more additional components (e.g., the at least one bracket 187) can be used additionally or alternatively to maintain the position of the sealing member 185 within the cavity 155 as the body 105 moves between positions.

In addition to the sealing member 185, one or more other components can be disposed in the channel adjacent to the sealing member 185. For example, as shown in FIGS. 1A through 1C, at least one bracket 187 (an optional component) is used to help maintain the position of the sealing member 185 when the body 105 is moved from one position to another position within the cavity 155. The bracket 187 can be an independent piece that is used to support at least a portion of the sealing member 185. The bracket 187 can be relatively rigid and made of one or more of any of a number of suitable materials (e.g., plastic, ceramic, metal).

In certain example embodiments, regardless of how many portions make up the housing 120 and whether other components, such as the at least one optional bracket 187, are coupled to or otherwise disposed within the housing 120, the housing 120, at least from the bottom end 123 up to the point where the sealing member 185 is located, is air-tight and water-tight. In this way, the housing 120 can prevent water, dust, and other contaminants from traversing therethrough. Such a configuration can be required to meet certain standards and/or codes that can apply to the environment and/or location in which the adjustable light fixture 100 is disposed.

As discussed above, an example adjustable light fixture 100 can include one or more coupling features 160. Each coupling feature 160 can be used to secure the adjustable light fixture 100 against a structure (e.g., a ceiling tile, drywall, wood). A coupling feature 160 can have any of a number of configurations and have any of a number of components. Such coupling features 160 can be common to those found in existing light fixtures. For example, as shown in FIGS. 1A through 1C, a coupling feature 160 can be a retention spring assembly that includes a clip 162 coupled to a spring 164. In this case, the spring 164 is mounted to portion 129 of the housing 120.

The housing 120 can also include a trim 122 that extends laterally away from the bottom end 123 of the wall 124 of the portion 121 of the housing 120. The trim 122 can be a decorative element of the housing 120 that can cover any gap between the housing 120 and a structure (e.g., a ceiling tile, drywall, wood) to which the housing 120 is mounted. In some cases, the trim 122 can be made of a thermally conductive material to dissipate heat generated by one or more of the components (e.g., the light source assembly 190) of the adjustable light fixture 100.

The trim 122 can also be used for one or more of a number of other purposes. For example, the trim 122 can be used to provide a seal or barrier with the structure. In such a case, as shown in FIG. 1A, the top side of the trim 122 can have a channel inside of which a sealing member 115 can be disposed. In such a case, the sealing member 115 can be compressed between the trim 122 and the structure to prevent air, dust, and/or other contaminants from traversing from the ambient environment 149 to the protected environment 155. As with the sealing member 185, the sealing member 115 can have any of a number of configurations (e.g., O-ring, gasket, silicone) and can be made of one or more of any number of materials.

The body 105 of the adjustable light fixture 100 is configured to be disposed, at least in part, within the cavity 155 formed by the housing 120. The body 105 can have any of a number of configurations and/or one or more portions. For example, as in this case, the outer perimeter of the body 105 (whether a single portion or multiple portions that are assembled together) can generally be a sphere that is truncated at the bottom end. At least some of this shape of the body 105 can be directly complimented by the shape of one or more walls of the housing 120. For example, as shown in FIG. 1A, part of the wall 126 of the upper portion 129 of the housing 120 matches the shape of the wall 141 of the upper portion 140 of the body 105.

As discussed above, the body 105 can have multiple portions. For example, as shown in FIG. 1A, approximately the bottom portion 150 of the body 105 includes one or more walls (e.g., wall 154, wall 152) that form a cavity 153. This cavity 153 can be open (unbounded by a wall) at the bottom and the top when the portion 150 is isolated from other components of the adjustable light fixture 100. Disposed within the cavity 193 can be one or more components of the adjustable light fixture 100. For example, as shown in FIG. 1A, a light source assembly 190 can be disposed at the top of the cavity 193. The light source assembly 190 generates and emits light into the ambient environment 149. The light source assembly 190 in this case includes one or more light sources 192 disposed on a circuit board 194. In some cases, the body 105 (or portions thereof) can be made of a thermally-conductive material (e.g., aluminum, thermoplastic) that absorbs heat generated by the light source assembly 190 and dissipates that heat in the ambient environment 149 and/or the protected environment 155.

As another example, an optional optical device 110 can be disposed at the bottom of the cavity 153. The optical device 110 can include one or more of a number of components, such as a lens. The optical device 110 can be used to manipulate (e.g., refract, reflect, change the color of) the light generated by the light source assembly 190 before that light is emitted into the ambient environment 149. The optical device 110 can be integrated with the body 105 as a single piece.

Alternatively, as shown in FIG. 1A, the optical device 110 can be permanently or removably coupled to the body 105. In such a case, the optical device 110 and the body 105 (or portion thereof) can include one or more coupling features (e.g., mating threads, tabs, recesses). For example, as shown in FIG. 1A, the inner surface of the distal end of the wall 154 of the portion 150 of the body 105 can have one or more coupling features 168 disposed thereon. Similarly, the outer surface of a wall of the optical device 110 can include one or more coupling features 169, where the coupling features 169 of the optical device 110 complement the coupling features 168 of the body 105. Such a configuration can allow a user to have a desired optical effect (e.g., beam forming, light dispersion, color temperature, color) at a given point in time by merely changing out one optical device 110 for another. Examples of such coupling features are shown below with respect to FIGS. 12A through 13E.

Another portion of the body 105 is one or more mechanical stops 180. A mechanical stop 180 can limit an amount of tilt and/or a range of rotation of the body 105 (or portion thereof) relative to the housing 120. For example, FIGS. 1A through 1C show an example of a mechanical stop 180 that is mounted atop the upper portion 140 of the body 105. In this case, the mechanical stop 180 limits the amount of tilt of the body 105 (when portion 140 and portion 150 are assembled together) relative to the housing 120 by contacting a top wall 127 of the housing 120. Examples of this are shown in FIG. 2 below.

A mechanical stop 180 can be a separate component that is permanently or removably coupled to the body 105. Alternatively, as in this example, a mechanical stop 180 can be integrated with the body 105 as a single piece. The adjustable light fixture 100 can have one mechanical stop 180 (as in this case) or multiple mechanical stops 180. Each mechanical stop 180 can be disposed at any point on the wall 141 of the portion 140 of the body 105. For example, as in this case, the mechanical stop 180 can be disposed at the approximate center of the wall 141 of the portion 140 of the body 105. By limiting the amount of rotation of the body 105 relative to the housing 120, the various requirements (e.g., air tight, water tight) of applicable standards and/or regulations can continue to be met, regardless of the position of the body 105 relative to the housing 120.

In this case, the mechanical stop 180 provides the added function of receiving and securing part of the cable 106 used to provide power and/or control signals to the circuit board 194 of the light source assembly 190. A mechanical stop 180 can have any of a number of configurations. For example, the mechanical stop 180 of FIGS. 1A through 1C has a cylindrical shape formed by at least one wall 182. In this case, the wall 182 has an opening along at least one side that allows for part of the cable 106 to be disposed therein.

Portion 140 and portion 150 are assembled together to form the body 105 in this example. Portion 140 and portion 150 can be assembled to each other in any of a number of ways. For example, portion 140 and portion 150 can be mechanically coupled to each other using one or more coupling features (e.g., mating threads, detents, tabs, recesses). As another example, as shown in FIGS. 1A and 1B, portion 140 and portion 150 of the body 105 can be configured in such a way as to have one component (e.g., portion 140) be seated within another component (e.g., portion 150) of the body 105.

In this particular case, portion 150 has extension 153 and wall 152 that extend upward from wall 154, forming a gap 151 therebetween. The gap 151 has dimensions (e.g., width, depth) sufficient to receive the distal end of wall 141 of portion 140. The gap 151 can be uniform around the circumference of portion 150. Alternatively, the gap 151 can have various features (e.g., interruptions, different depths, different widths) that can be based on corresponding features of the distal end of the wall 141 of portion 140. In this case, there is nothing that keeps the distal end of wall 141 of portion 140 within the gap 151 aside from gravity.

Portion 150 can include one or more other features, as well. For example, as shown in FIG. 1B, a number of extensions can extend upward from the top wall 156 of portion 150. Extension 118 is used to help retain and secure the cable 106 to prevent the electrical conductors of the cable 106 that connect to the circuit board 194 of the light source assembly 190 from becoming disconnected. Extension 157 has two protrusions 158 and 159 that extend upward therefrom. Protrusion 158 and protrusion 159 form a gap 139 into which part of a resilient device 186 can be disposed. In other words, protrusion 158 and protrusion 159 are used to secure the resilient device 186 in place between portion 140 and portion 150.

The resilient device 186 can be any device or component that can become compressed (in the presence of some force) or expanded to a nominal size/configuration (in the absence of such a compressive force). In this case, the resilient device 186 is a spring, but the resilient device 186 can take on any of a number of other configurations. For example, the resilient device 186 can be a type of piston. As another example, the resilient device 186 can be a type of bladder that evacuates and fills with some fluid (e.g., air, a liquid) for the compression and expansion. The resilient device 186 can be made of one or more of any of a number of suitable materials (e.g., metal, plastic).

Similarly, the bottom surface of portion 140 of the body 105 can include one or more features that are used to retain the resilient device 186. For example, as shown in FIG. 1B, protrusion 143 and protrusion 142 can extend downward from the bottom surface of wall 141 of portion 140, forming a gap 138 therebetween. Part of the top of the resilient device 186 can be disposed within the gap 138. When the resilient device 186 is disposed within both gap 138 and gap 139, the distal end of wall 141 of portion 140, with sufficient downward force to compress the resilient device 186, can be disposed within gap 151.

One or more of these protrusions of portion 140 can overlap with one or more features of portion 150 to help ensure proper alignment between portion 150 and portion 140. For example, as shown in FIG. 1B, protrusion 158 that extends upward from extension 157 of portion 150 can be disposed within the gap 138 formed between protrusion 142 and protrusion 143 of portion 140. In this example, the resilient device 186 is disposed between protrusion 158 and protrusion 143 within the gap 138.

The configuration of the adjustable light fixture 100 of FIGS. 1A through 1C allows for easy access to its various components. For example, portion 121 and portion 129 of the housing 120 can be mechanically coupled to each other using one or more of a number of coupling features (e.g., screws, threaded apertures, tabs, recesses). When portion 121 and portion 129 of the housing 120 are decoupled from each other, the body 105 becomes accessible and can be removed from the cavity 155. By contrast, when portion 121 and portion 129 of the housing 120 are coupled to each other, the body 105 can rotate, tilt, and otherwise move within the cavity 155, subject to limitations imposed by features such as the mechanical stop 180 interacting with the top wall 187 of the housing 120.

As discussed above, the resilient device 186 has a natural, uncompressed state and a compressed state. When in the compressed state, the resilient device 186 attempts to return to the uncompressed state. In this case, when the resilient device is placed between portion 140 and portion 150 of the body 105 as shown in FIGS. 1A and 1B and as described above, and when portion 140 and portion 150 of the body 105 are assembled, and the resilient device 186 is in the compressed state. As a result, in the absence of some force to keep the resilient device 186 in the compressed state, the resilient device 186 reverts to the uncompressed (natural) state, which disassembles portion 140 and portion 150 from each other.

When the assembled body 105 is disposed within the cavity 155 formed by the housing 120, as shown in FIGS. 1A through 1C, the housing 120 provides that compressive force that retains the resilient device 186 in the compressed state. Specifically, the bottom end 123 of the portion 121 of the housing 120 retains the bottom of portion 150 of the body 105, and the top wall 127 of the portion 129 of the housing 120, with the added layering of the bracket 187 and the sealing member 185, retains the upper end of portion 140 of the body 105.

As shown in FIGS. 1A and 1B, the configuration of the housing 105 can allow for a range of space in which in which the distal end of the wall 141 of portion 140 of the body 105 nominally has within the gap 151 formed between wall 152, wall 153, and wall 154 of portion 150 of the body 105. Alternatively, the configuration of the housing 105 can force the distal end of the wall 141 of portion 140 of the body 105 to abut against wall 154 of portion 150 of the body 105 within the gap 151.

In any case, while the body 105 is positioned within the housing 120, portion 140 and portion 150 of the body 105 remain coupled to each other. In this way, while portion 140 and portion 150 may be able to rotate independently of each other along the central axis 104 of the housing 105 (depending on how the distal end of the wall 141 of portion 140 and/or the gap 151 of portion 150 are configured), portion 150 and portion 140 move at an angle as a unit, where the angle is formed between the central axis 104 of the body 105 and the central axis 119 of the housing 120. In FIGS. 1A through 1C, the angle is 0°.

FIG. 2 shows a cross-sectional side view of the adjustable light fixture 100 of FIGS. 1A through 1C in a tilted position. Referring to FIGS. 1A through 2, the adjustable light fixture 100 of FIG. 2 shows that the body 105 has been moved so that the central axis 104 of the body 105 and the central axis 119 of the housing 120 form an angle 103. The angle 103 (e.g., 30°, 20°) in this case is at a maximum because the mechanical stop 180 abuts against the top wall 127 of the portion 129 of the housing 120. The angle 103 is maintained in this position because the outer surface of the wall 141 of the portion 140 of the body 105 abuts against the sealing member 185, which uses friction to retain the position of the body 105 relative to the housing 120.

As discussed above, this abutment of the outer surface of the wall 141 of the portion 140 of the body 105 against the sealing member 185 results from the resilient device 186 pushing the portion 140 of the body 105 upward and the portion 150 of the body 105 downward. When this occurs, the distal end of the wall 154 of portion 150 abuts against the the bottom end 123 of the portion 121 of the housing 120, and simultaneously the wall 141 of portion 140 of the body 105 abuts against the sealing member 185, held in place, directly or indirectly, by the top wall 127 of the portion 129 of the housing 120. To change the angle 103 and/or to rotate the body 105 relative to the housing 120, a user merely needs to apply a sufficient amount of force (e.g., to the optical device 110) to overcome the friction force applied by the sealing member 185 to the wall 141 of the portion 140 of the body 105.

Figure 3A:
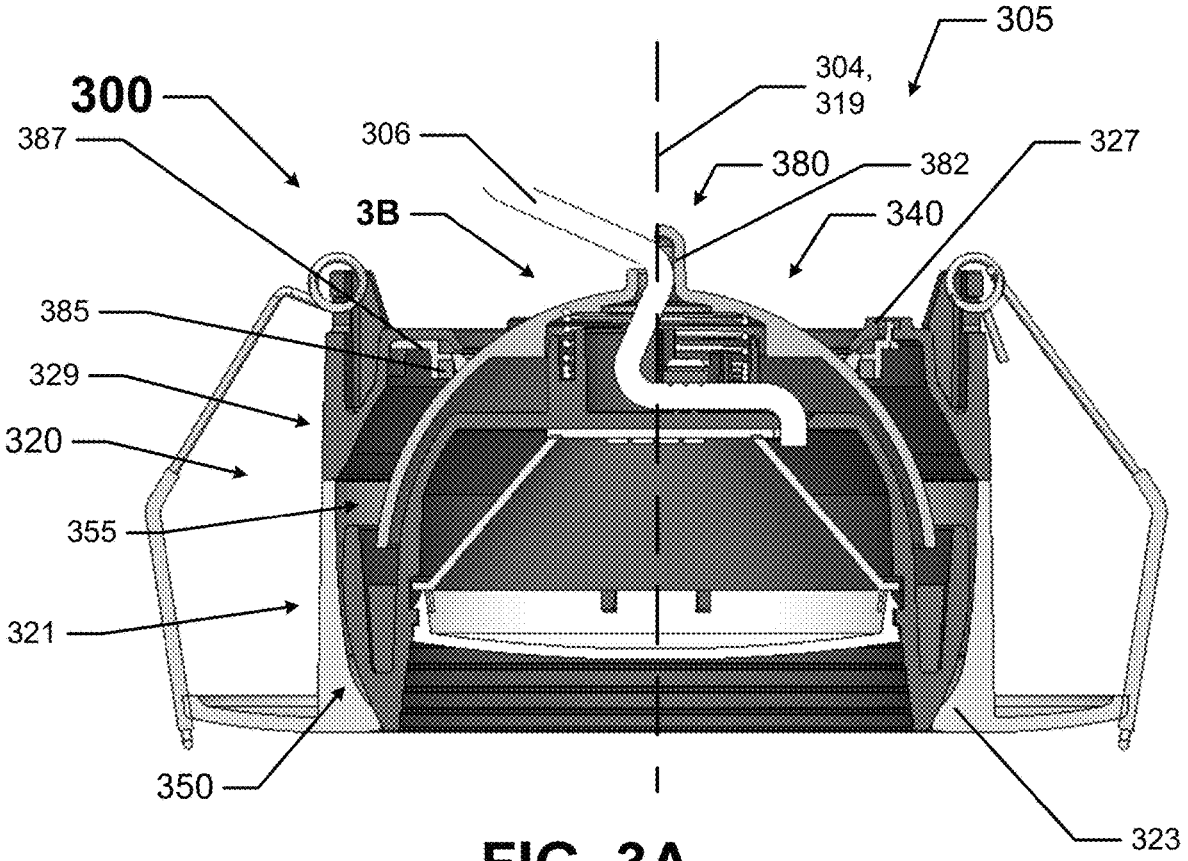
FIGS. 3A and 3B show cross-sectional side views of part of another adjustable light fixture in a nominal position in accordance with certain example embodiments.
Figure 3B:
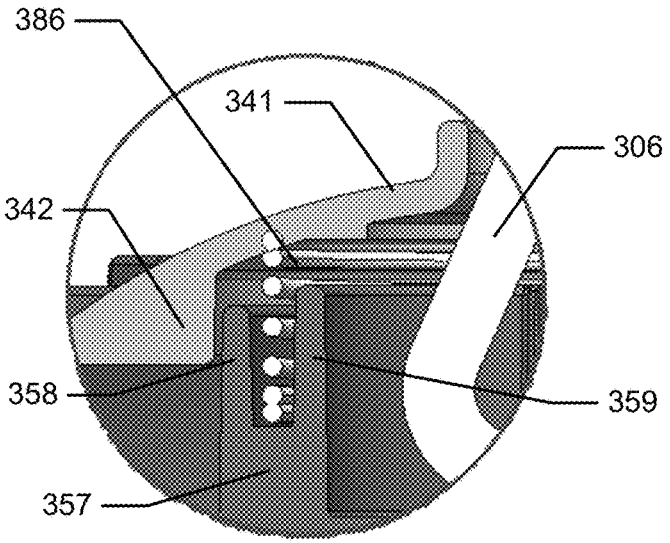

FIGS. 3A and 3B show cross-sectional side views of another adjustable light fixture 300 in a nominal position in accordance with certain example embodiments. Specifically, FIG. 3A shows a cross-sectional side view of the entire adjustable light fixture 300, and FIG. 3B shows a cross-sectional side view of detailed section of the adjustable light fixture 300. Referring to FIGS. 1A through 3B, the adjustable light fixture 300 of FIGS. 3A and 3B can include components that are substantially similar to the components of the adjustable light fixture 100 of FIGS. 1A through 2, except as described below.

For example, the adjustable light fixture 300 of FIGS. 3A and 3B includes a housing 302 having a lower portion 321 and an upper portion 329 that are coupled to each other and form a cavity 355. The adjustable light fixture 300 also includes a body 305 that is disposed within the cavity 355, where the body 305 has a lower portion 350 and an upper portion 340 that are assembled together within the cavity 355. A resilient member 386 is disposed between the lower portion 350 and the upper portion 340 of the body 305.

A mechanical stop 380, which includes at least one wall 382, is disposed at the approximate center of the outer surface of the wall 341 of portion 340 of the body 305. A portion of a cable 306 is disposed within the resilient member 386, and another portion of the cable 306 is disposed in the mechanical stop 380. A sealing member 385 abuts against the outer surface of the wall 341 of portion 340 of the body 305. A bracket 387 is located atop (and/or otherwise adjacent to) the sealing member 385, and the bracket 387 and sealing member 385 are sandwiched between the wall 341 of portion 340 of the body 305 and the top wall 327 of portion 329 of the housing 320. Since the adjustable light fixture 300 is in a nominal position, the central axis 304 of the body 305 is coincident with the central axis 319 of the housing 320.

One of the differences between the adjustable light fixture 300 of FIGS. 3A and 3B and the adjustable light fixture 100 of FIGS. 1A through 2 is how the resilient member 386 is secured between the lower portion 350 and the upper portion 340 of the body 305. In this case, only one protrusion 342 extends downward from the inner surface of the wall 341 of the upper portion 340 of the body 305. Also, protrusion 358 and protrusion 359, both of which extend from extension 357 of the lower portion 350 of the body 305, are longer than their counterparts of the adjustable light fixture 100 of FIGS. 1A through 2.

Figure 4:
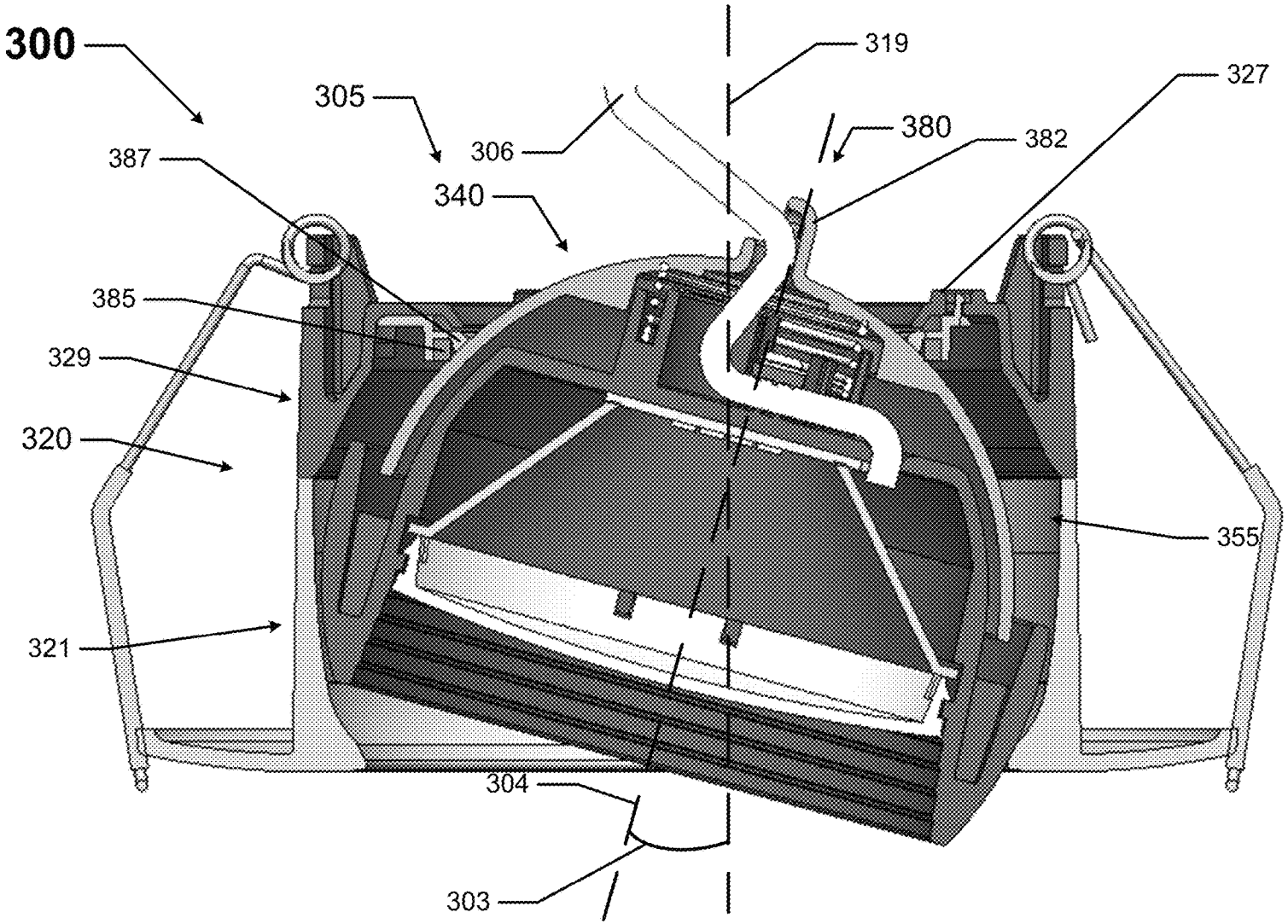
FIG. 4 shows a cross-sectional side view of the adjustable light fixture of FIGS. 3A and 3B in a tilted position.

FIG. 4 shows a cross-sectional side view of the adjustable light fixture 300 of FIGS. 3A and 3B in a tilted position. Referring to FIGS. 1A through 4, the adjustable light fixture 300 of FIG. 4 shows that the body 305 has been moved so that the central axis 304 of the body 305 and the central axis 319 of the housing 320 form an angle 303. The angle 303 (e.g., 30°, 20°) in this case is not at a maximum because the mechanical stop 380 does not abut against the top wall 327 of the portion 329 of the housing 320. The angle 303 is maintained in this position because the outer surface of the wall 341 of the portion 340 of the body 305 abuts against the sealing member 385, which uses friction to retain the position of the body 305 relative to the housing 320.

As discussed above, this abutment of the outer surface of the wall 341 of the portion 340 of the body 305 against the sealing member 385 results from the resilient device 386 pushing the portion 340 of the body 305 upward and the portion 350 of the body 305 downward. When this occurs, the distal end of the wall 354 of portion 350 abuts against the the bottom end 323 of the portion 321 of the housing 320, and simultaneously the wall 341 of portion 340 of the body 305 abuts against the sealing member 385, held in place, directly or indirectly, by the top wall 327 of the portion 329 of the housing 320. To change the angle 303 and/or to rotate the body 305 relative to the housing 320, a user merely needs to apply a sufficient amount of force (e.g., to the optical device 310) to overcome the friction force applied by the sealing member 385 to the wall 341 of the portion 340 of the body 305.

Figure 5A:
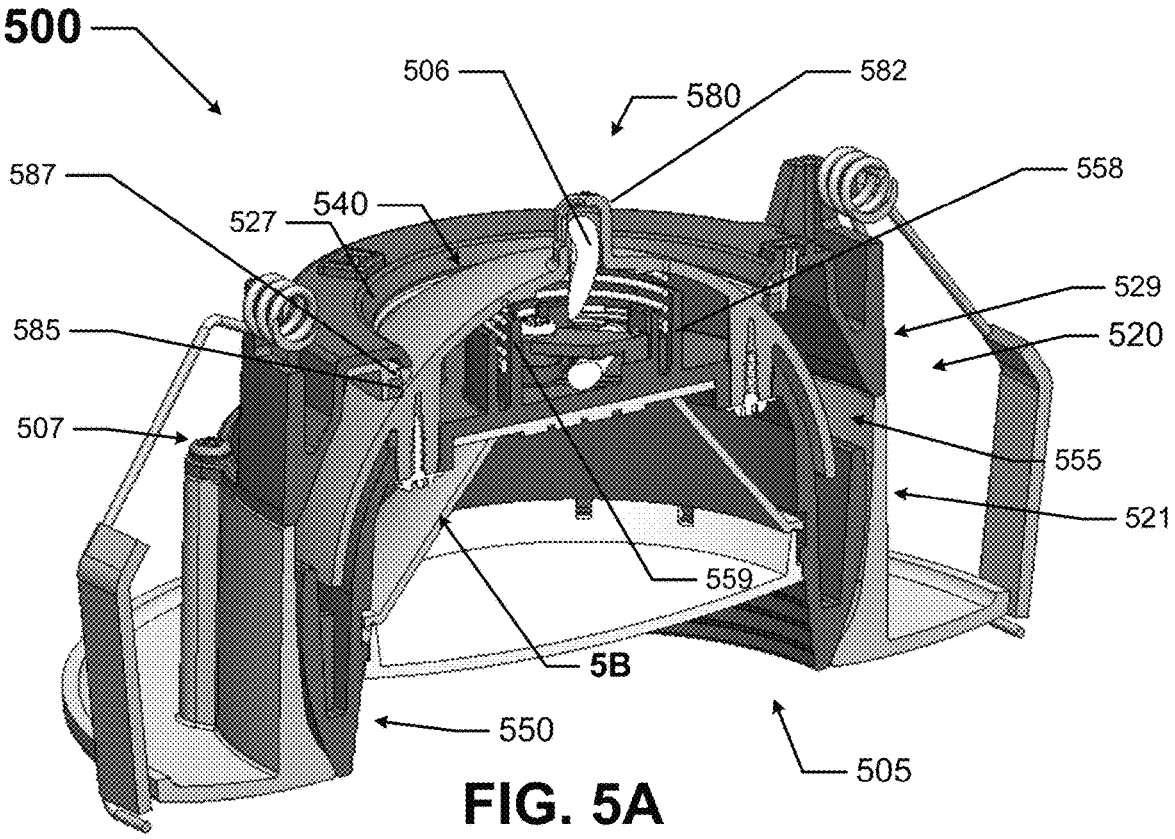
FIGS. 5A and 5B show cross-sectional side perspective views of part of yet another adjustable light fixture in a nominal position in accordance with certain example embodiments.
Figure 5B:
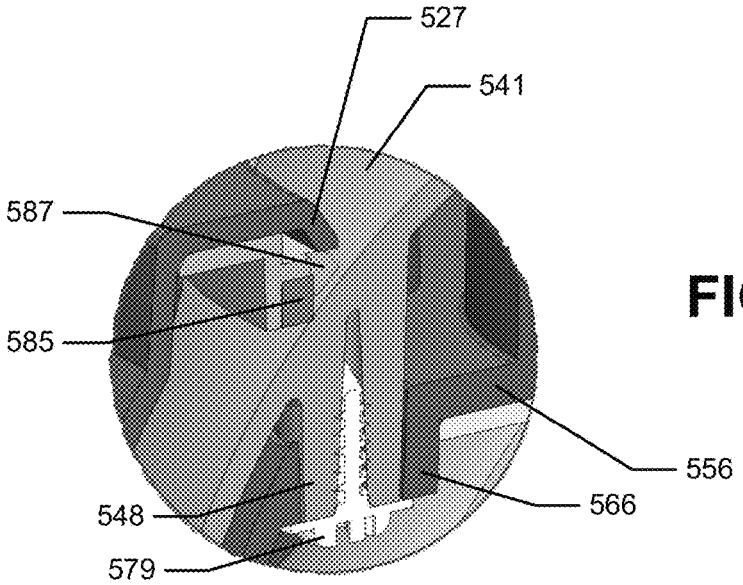

FIGS. 5A and 5B show cross-sectional side perspective views of another adjustable light fixture 500 in a nominal position in accordance with certain example embodiments. Specifically, FIG. 5A shows a cross-sectional side view of the entire adjustable light fixture 500, and FIG. 5B shows a cross-sectional side view of detailed section of the adjustable light fixture 500. Referring to FIGS. 1A through 5B, the adjustable light fixture 500 of FIGS. 5A and 5B can include components that are substantially similar to the components of the adjustable light fixture 100 and the adjustable light fixture 300, except as described below.

For example, the adjustable light fixture 500 of FIGS. 5A and 5B includes a housing 502 having a lower portion 521 and an upper portion 529 that are coupled to each other and form a cavity 555. The adjustable light fixture 500 also includes a body 505 that is disposed within the cavity 555, where the body 505 has a lower portion 550 and an upper portion 540 that are assembled together within the cavity 555. A resilient member 586 is disposed between the lower portion 550 and the upper portion 540 of the body 505.

A mechanical stop 580, which includes at least one wall 582, is disposed at the approximate center of the outer surface of the wall 541 of portion 540 of the body 505. A portion of a cable 506 is disposed within the resilient member 586, and another portion of the cable 506 is disposed in the mechanical stop 580. A sealing member 585 abuts against the outer surface of the wall 541 of portion 540 of the body 505. A bracket 587 is located atop (and/or otherwise adjacent to) the sealing member 585, and the bracket 587 and sealing member 585 are sandwiched between the wall 541 of portion 540 of the body 505 and the top wall 527 of portion 529 of the housing 520. Since the adjustable light fixture 500 is in a nominal position, the central axis 504 of the body 505 is coincident with the central axis 519 of the housing 520.

One of the differences between the adjustable light fixture 500 of FIGS. 5A and 5B and the adjustable light fixture of FIGS. 3A through 4 is how the resilient member 586 is secured between the lower portion 550 and the upper portion 540 of the body 505. In this case, there is no protrusion 542 that extends downward from the inner surface of the wall 541 of the upper portion 540 of the body 505. Also, protrusion 558 and protrusion 559, both of which extend from extension 557 of the lower portion 550 of the body 505, are longer than their counterparts of the adjustable light fixture 100 of FIGS. 1A through 2.

Another difference between the adjustable light fixture 500 of FIGS. 5A and 5B and the adjustable light fixtures of FIGS. 1A through 4 is that one or more protrusions 587 extends downward from the inner surface of the wall 541 of the upper portion 540 of the body 505. These protrusions 587 are disposed within corresponding protrusions 566, which are apertures that extend from the bottom surface of wall 556 of the lower portion 550 of the body 505. Each protrusion 587 has its own aperture into which a coupling feature 579 (in this case, a screw) is disposed. The head of the screw in this case extends laterally away to an extent that the it abuts against the distal end of the corresponding protrusion 566, acting as a means to limit the maximum amount of force that the resilient device 586 can apply to portion 540 of the body 505 against the sealing member 585.

Figure 6:
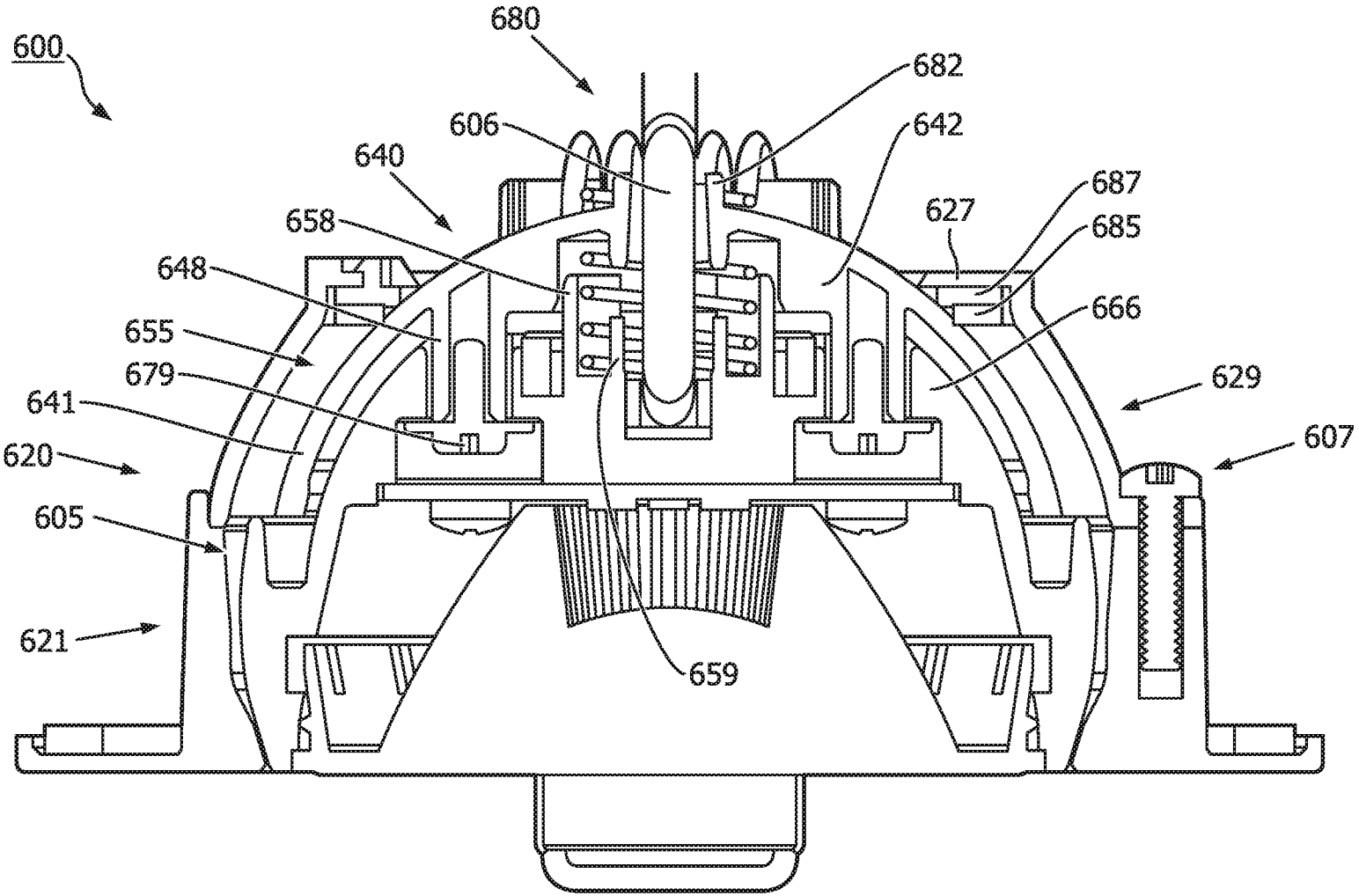
FIG. 6 shows a cross-sectional side view of still another adjustable light fixture in accordance with certain example embodiments.

FIG. 6 shows a cross-sectional side view of still another adjustable light fixture 600 in accordance with certain example embodiments. Referring to FIGS. 1 through 6, the adjustable light fixture 600 of FIG. 6 can include components that are substantially similar to the components of the adjustable light fixture 100, the adjustable light fixture 300, and the adjustable light fixture 500, except as described below.

For example, the adjustable light fixture 600 of FIGS. 6A and 6B includes a housing 602 having a lower portion 621 and an upper portion 629 that are coupled to each other and form a cavity 655. The adjustable light fixture 600 also includes a body 605 that is disposed within the cavity 655, where the body 605 has a lower portion 650 and an upper portion 640 that are assembled together within the cavity 655. A resilient member 686 is disposed between the lower portion 650 and the upper portion 640 of the body 605.

A mechanical stop 680, which includes at least one wall 682, is disposed at the approximate center of the outer surface of the wall 641 of portion 640 of the body 605. A portion of a cable 606 is disposed within the resilient member 686, and another portion of the cable 606 is disposed in the mechanical stop 680. A sealing member 685 abuts against the outer surface of the wall 641 of portion 640 of the body 605. A bracket 687 is located atop (and/or otherwise adjacent to) the sealing member 685, and the bracket 687 and sealing member 685 are sandwiched between the wall 641 of portion 640 of the body 605 and the top wall 627 of portion 629 of the housing 620. Since the adjustable light fixture 600 is in a nominal position, the central axis 604 of the body 605 is coincident with the central axis 619 of the housing 620.

Similar to the adjustable light fixture 300 of FIGS. 3A through 4 is how the resilient member 686 is secured between the lower portion 650 and the upper portion 640 of the body 605. Specifically, there is a protrusion 642 that extends downward from the inner surface of the wall 641 of the upper portion 640 of the body 605. Also, protrusion 658 and protrusion 659, both of which extend from extension 657 of the lower portion 650 of the body 605, are longer than their counterparts of the adjustable light fixture 100 of FIGS. 1A through 2.

Also, similar to the adjustable light fixture 500 of FIGS. 5A and 5B, there are one or more protrusions 687 extend downward from the inner surface of the wall 641 of the upper portion 640 of the body 605. These protrusions 687 are disposed within corresponding protrusions 666, which are apertures that extend from the bottom surface of wall 656 of the lower portion 650 of the body 605. Each protrusion 687 has its own aperture into which a coupling feature 679 (in this case, a screw) is disposed. The head of the coupling feature 679 in this case extends laterally away to an extent that the it abuts against the distal end of the corresponding protrusion 666, acting as a means to limit the maximum amount of force that the resilient device 686 can apply to portion 640 of the body 605 against the sealing member 685.

Figure 7:
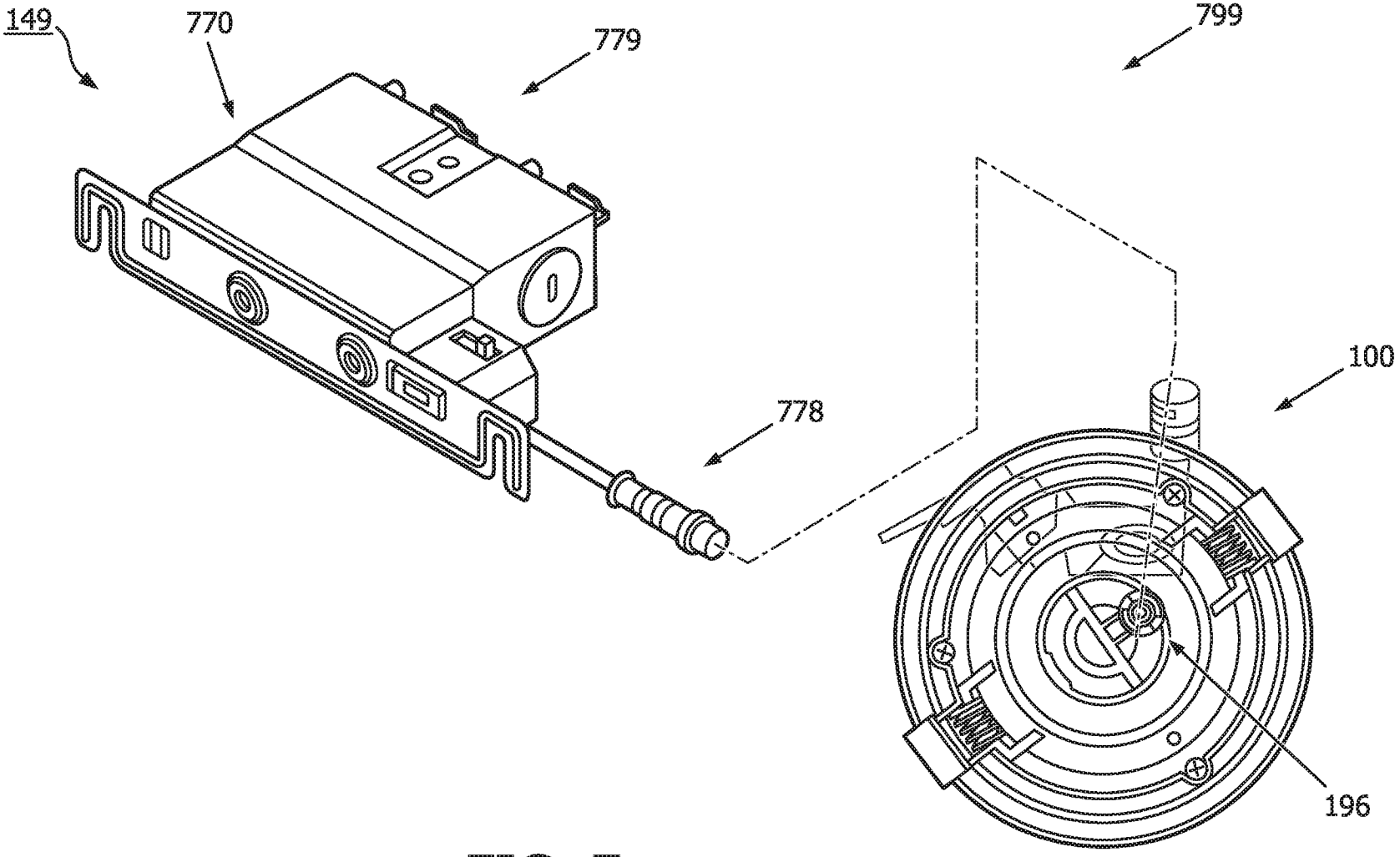
FIG. 7 shows a top-side perspective view of an assembly that includes a light fixture in accordance with certain example embodiments.

FIG. 7 shows a top-side perspective view of an assembly 799 that includes the adjustable light fixture 100 of FIGS. 1A through 1C. Referring to FIGS. 1A through 7, in addition to the light fixture 100, the assembly 799 of FIG. 7 includes a subassembly 779 that includes a junction box 770 and a cable assembly 778. One end of the cable assembly 778 in this case is a connector end that is coupled to a connector on the junction box 770 or to one or more electrical devices disposed within the junction box 770. The other end of the cable assembly 778 is configured to couple to the connector end 196 that extends away from the adjustable light fixture 100. The assembly 799 is located in an ambient environment 149, such as above a ceiling or other structure.

FIGS. 8 through 11 show various trims that can be used with adjustable light fixtures in accordance with certain example embodiments. Referring to FIGS. 1A through 11, as discussed above, the trim (e.g., trim 122) of an example adjustable light fixture can be a decorative piece in addition to serving one or more practical functions. In some cases, in similar ways that the optical assembly can be interchangeable, the trim of an adjustable light fixture can be replaceable and interchangeable. Such a feature may be desired, for example, because the trim is the most visible component of an adjustable light fixture in an ambient environment (e.g., ambient environment 149). In addition, or in the alternative, such a feature may be needed to cover up gaps when a person installing the light fixture into a structure (e.g., a ceiling) cuts a hole that is too large.

Figure 9:
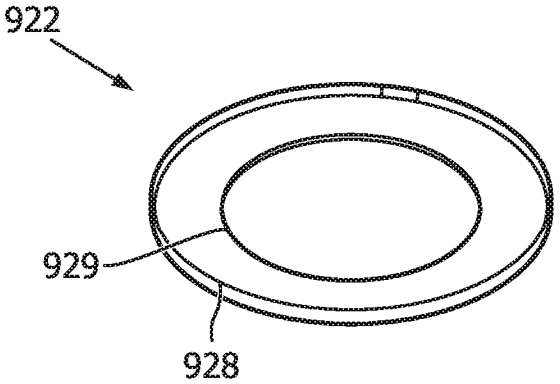
FIGS. 8 through 11 show various trims that can be used with adjustable light fixtures in accordance with certain example embodiments.
Figure 8:
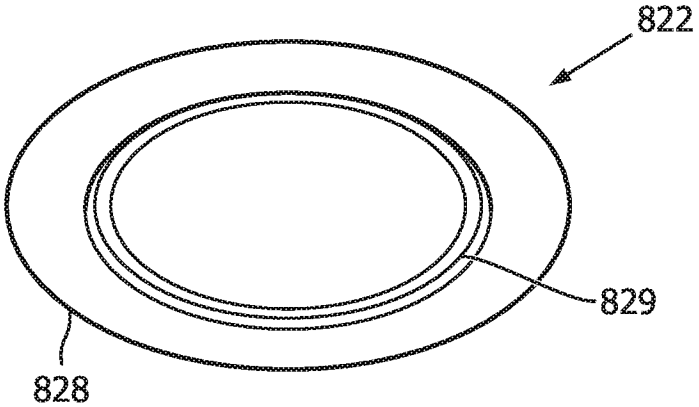

Such a change can be made because of one or more desired characteristics, including but not limited to shape, color, sensor integration, sound absorption, reflectivity, and texture. FIGS. 8 through 11 show variations in the shape of the trim. Specifically, FIG. 8 shows a trim 822 with a circular outer perimeter 828 and a circular inner perimeter 829, where the inner perimeter 829 has a decorative tiered configuration. FIG. 9 shows a trim 922 with a circular outer perimeter 928 and a circular inner perimeter 929, where the outer perimeter 929 has a decorative tiered configuration.

Figure 11:
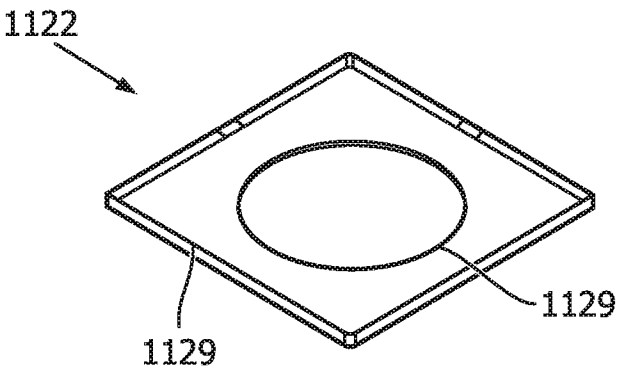
Figure 10:
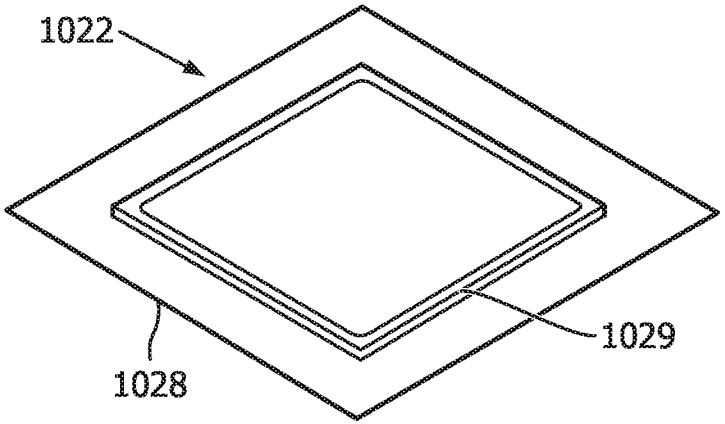

FIG. 10 shows a trim 1022 with a square outer perimeter 1028 and a square inner perimeter 1029, where the inner perimeter 1029 has a decorative tiered configuration. FIG. 11 shows a trim 1122 with a square outer perimeter 1128 and a circular inner perimeter 1129, where the outer perimeter 1129 has a decorative tiered configuration. In certain example embodiments, the configuration of the trim has no effect on the adjustability of the body relative to the housing of the adjustable light fixture.

Figure 12B:
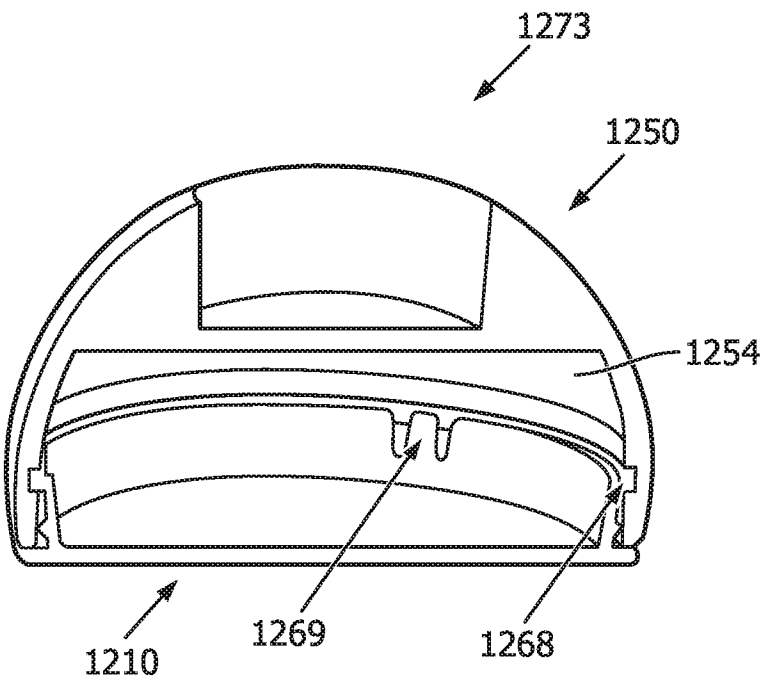
FIGS. 12A through 12D show various views of a subassembly of an adjustable light fixture in accordance with certain example embodiments.
Figure 12A:
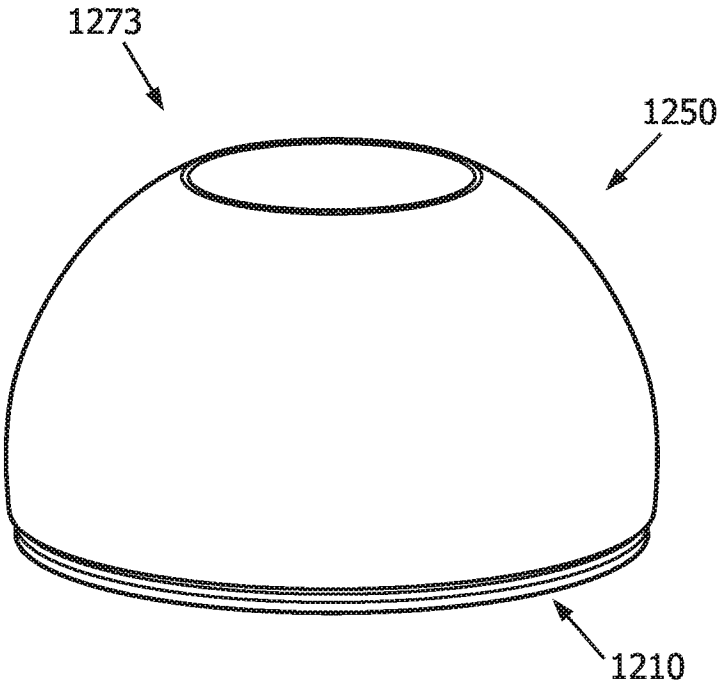
Figure 12D:
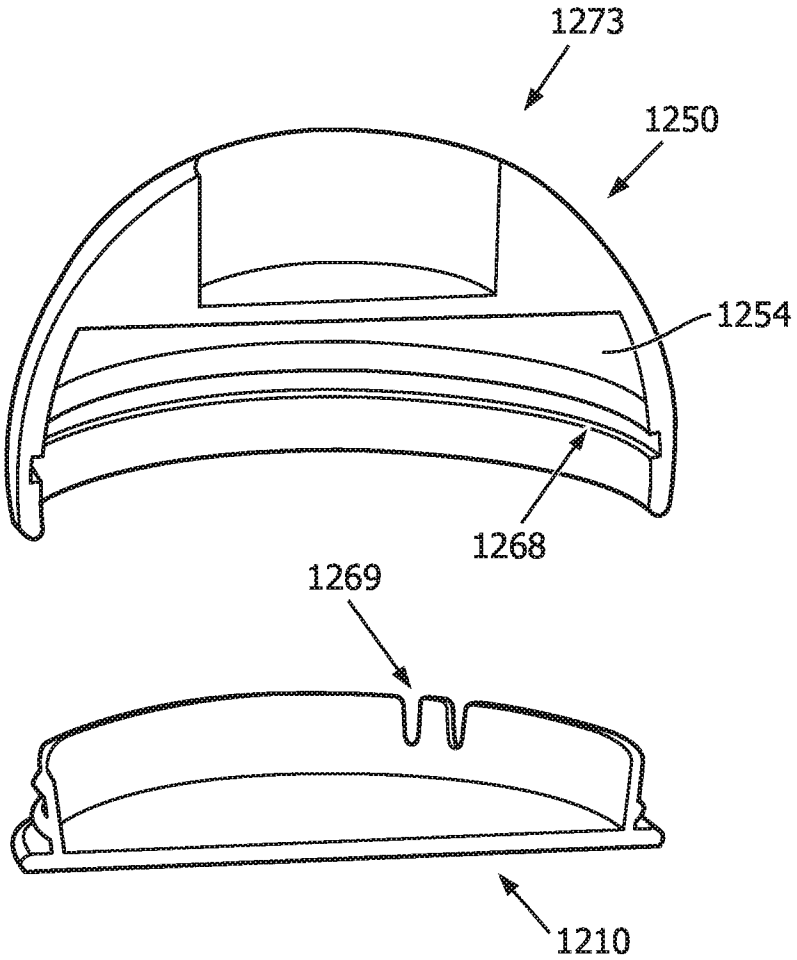
Figure 12C:
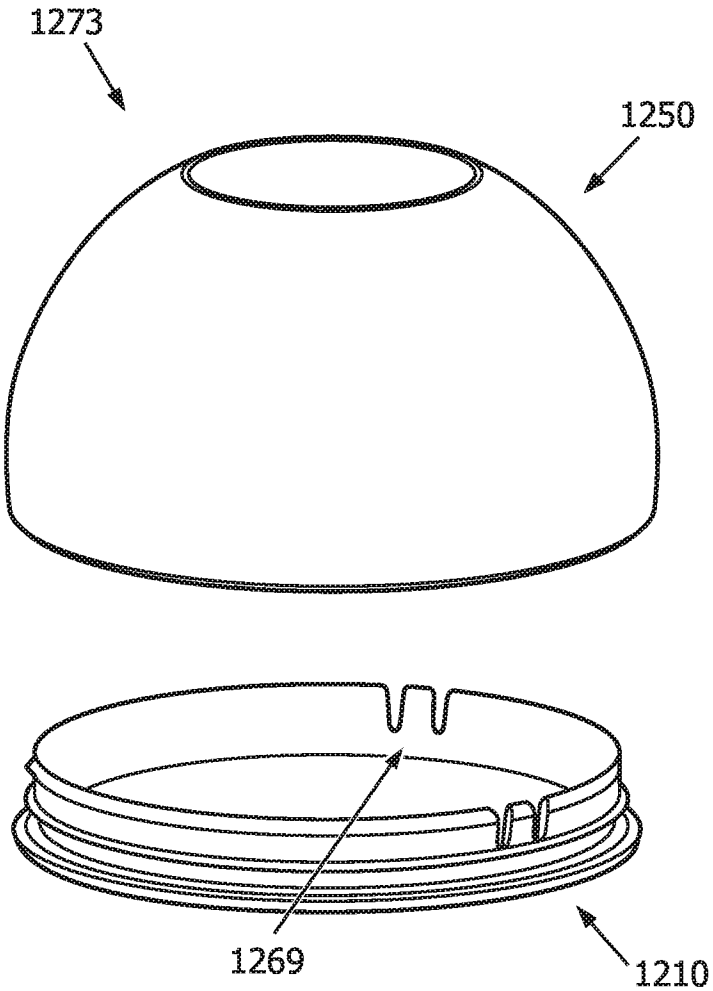

FIGS. 12A through 12D show various views of a subassembly 1273 of an adjustable light fixture in accordance with certain example embodiments. Specifically, FIG. 12A shows a top-side perspective view of the subassembly 1273. FIG. 12B shows a cross-sectional top-side perspective view of the subassembly 1273. FIG. 12C shows an exploded top-side perspective view of the subassembly 1273. FIG. 12D shows an exploded cross-sectional top-side perspective view of the subassembly 1273.

Referring to FIGS. 1A through 12D, the subassembly 1273 of FIGS. 12A through 12D includes portion 1250 (substantially similar to the corresponding portions discussed above, such as portion 150 of the body 105 of FIGS. 1A through 1C) and an optical assembly 1210 (substantially similar to the optical assembly 110 of FIGS. 1A through 1C). As discussed above, with respect to FIGS. 1A through 1C, the optical assembly 110 can detachably couple to portion 1250, allowing for interchangeable optical assemblies that have different features (e.g., color, temperature, refraction features, reflection features).

In this case, the inner surface of portion 1250 has a coupling feature 1268 disposed toward the bottom of portion 1250. In this case, the coupling feature 1268 is a slot disposed continuously along the inner surface of the wall 1254 of portion 1250. Similarly, the optical device 1210 includes one or more coupling features 1269 disposed around its outer perimeter. In this case, the coupling features 1269 are tabs with extensions that coincide with the coupling feature 1268 to allow the optical device 1210 to couple to portion 1250. There can be any number (in this case, two) of coupling features 1269. When the optical device 1210 has multiple coupling features 1269, these coupling features 1269 can be spaced around the outer perimeter of the optical device 1210 in any fashion (e.g., symmetrically, asymmetrically).

Figure 13B:
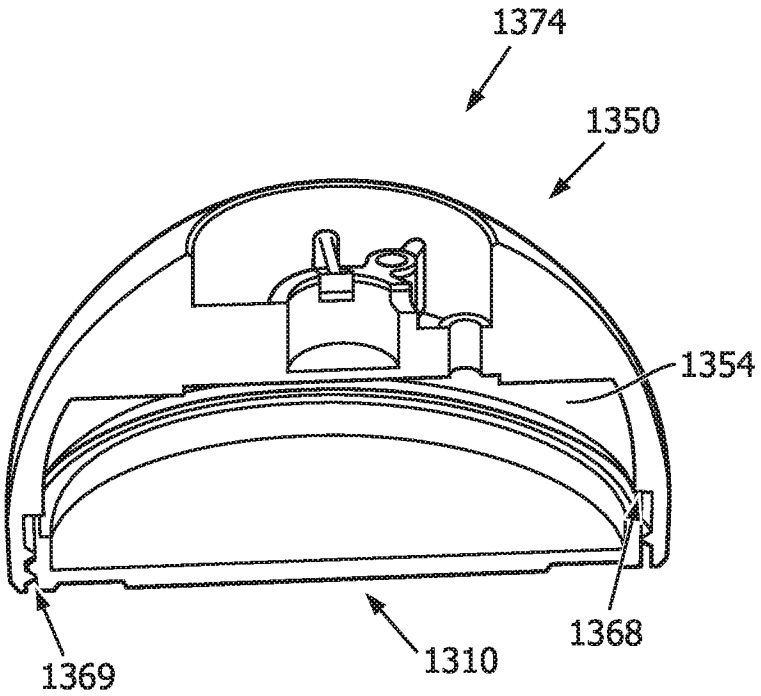
FIGS. 13A through 13E show various views of a subassembly of an adjustable light fixture in accordance with certain example embodiments.
Figure 13A:
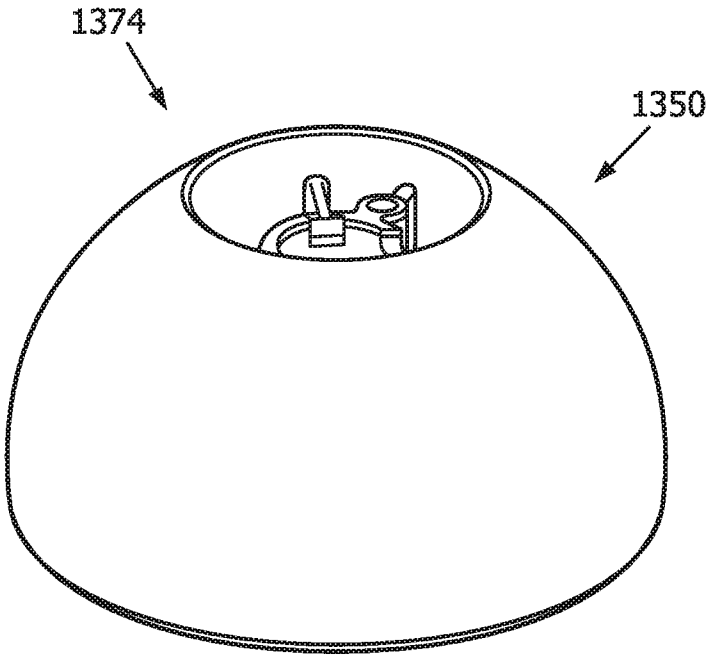

FIGS. 13A through 13E show various views of a subassembly 1374 of an adjustable light fixture in accordance with certain example embodiments. Specifically, FIG. 13A shows a top-side perspective view of the subassembly 1374.

Figure 13D:
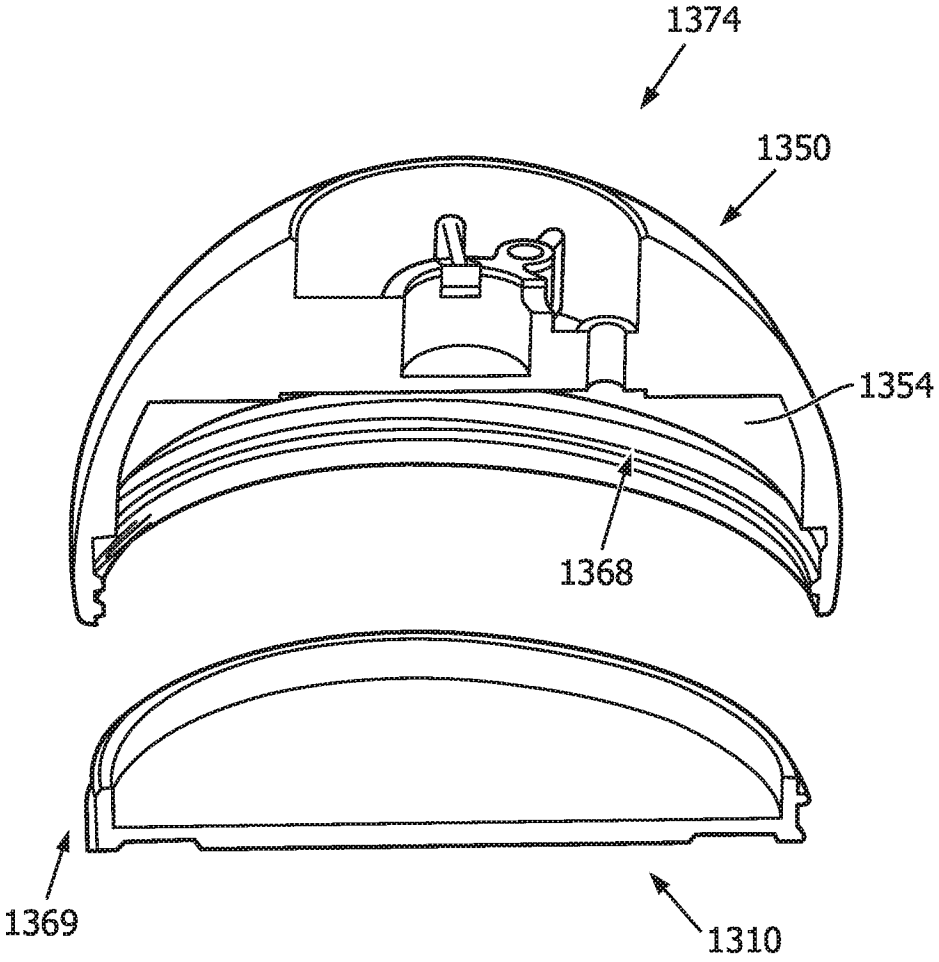
Figure 13C:
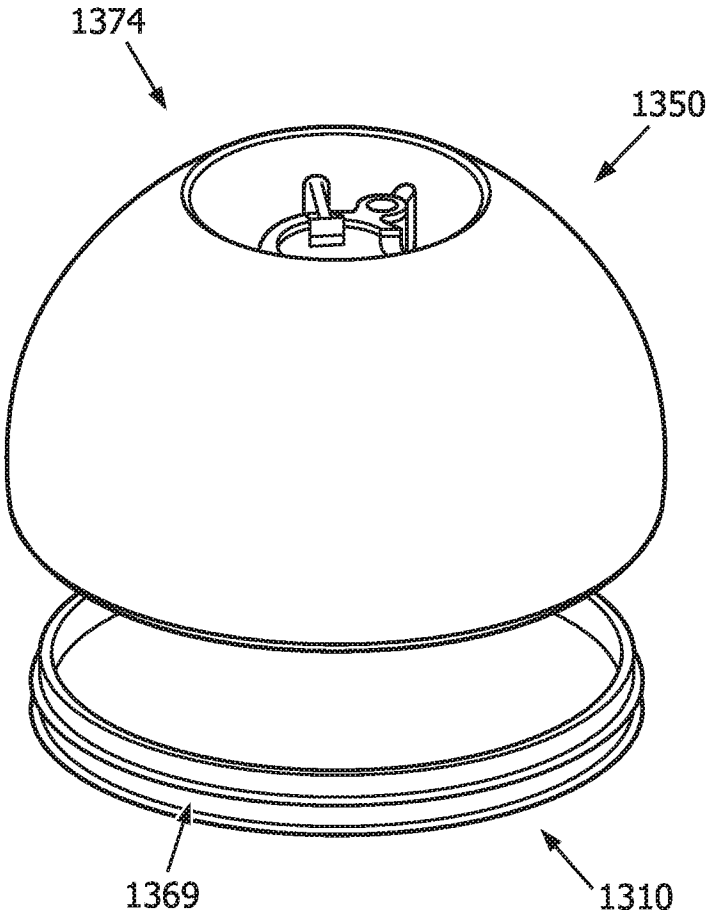
Figure 13E:
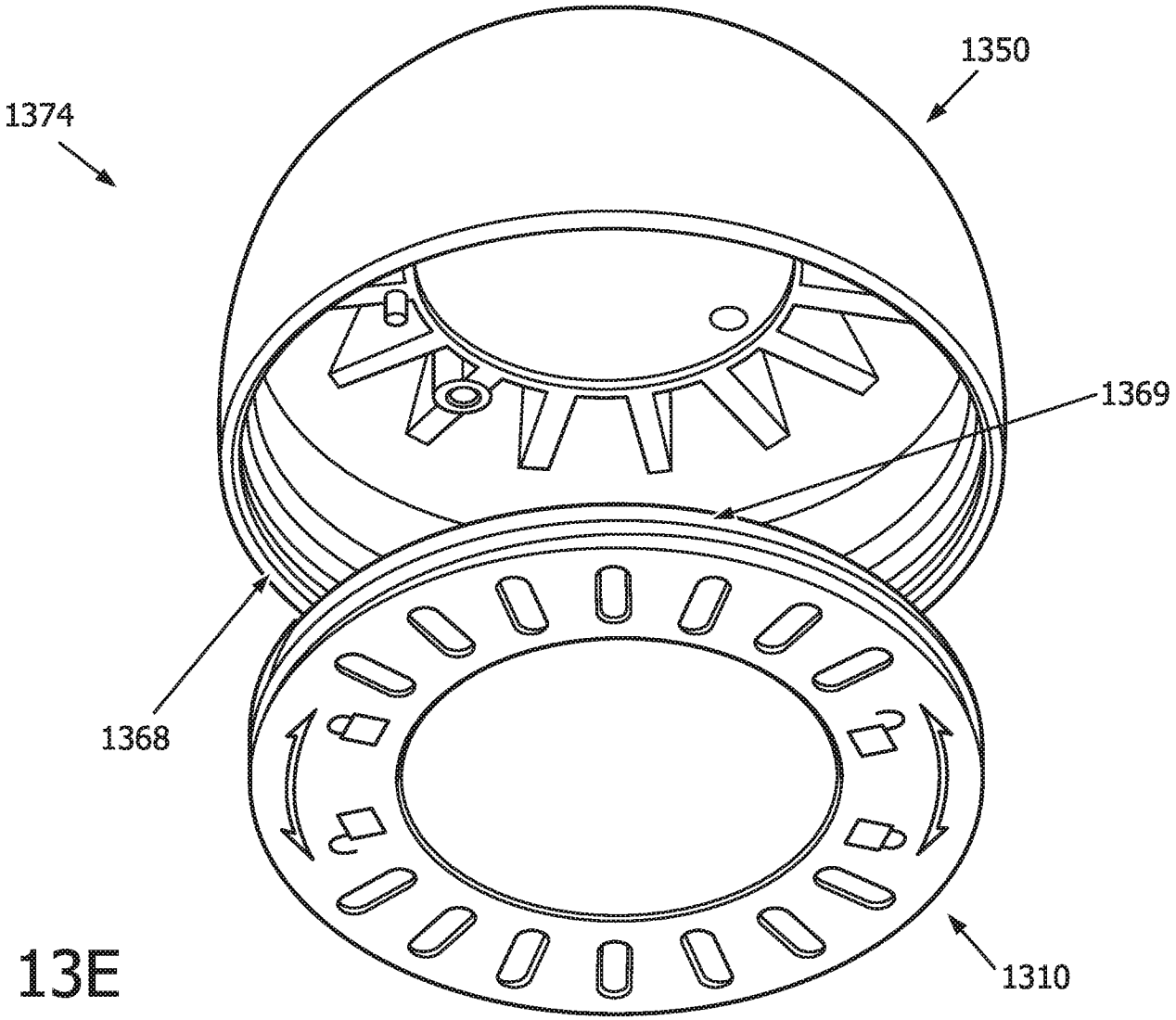

FIG. 13B shows a cross-sectional top-side perspective view of the subassembly 1374. FIG. 13C shows an exploded top-side perspective view of the subassembly 1374. FIG. 13D shows an exploded cross-sectional top-side perspective view of the subassembly 1374. FIG. 13E shows an exploded bottom-side perspective view of the subassembly 1374.

Referring to FIGS. 1A through 13E, the subassembly 1374 of FIGS. 13A through 13E includes portion 1350 (substantially similar to the corresponding portions discussed above, such as portion 150 of the body 105 of FIGS. 1A through 1C) and an optical assembly 1310 (substantially similar to the optical assembly 110 of FIGS. 1A through 1C). As discussed above, with respect to FIGS. 1A through 1C, the optical assembly 110 can detachably couple to portion 1350, allowing for interchangeable optical assemblies that have different features.

In this case, the inner surface of portion 1350 has a coupling feature 1368 disposed toward the bottom of portion 1350. In this case, the coupling feature 1368 is mating threads disposed continuously along the inner surface of the wall 1354 of portion 1350. Similarly, the optical device 1310 includes one or more coupling features 1369 disposed around its outer perimeter. In this case, the coupling feature 1369 is complementary mating threads that coincide with the coupling feature 1368 to allow the optical device 1310 to couple to portion 1350. The mating threads of coupling feature 1368 and coupling feature 1369 can be configured to allow for multiple revolutions of the optical device 1310 or less than one revolution (e.g., ¼ revolution, ½ revolution) before optical device 1310 is fully coupled to portion 1350. Rotating the optical device 1310 in one direction (e.g., clockwise) can couple the optical device 1310 to portion 1350. Conversely, rotating the optical device 1310 in the opposite direction (e.g., counter-clockwise) can decouple the optical device 1310 from portion 1350.

The examples of types of coupling features described above in FIGS. 12A through 13E are just two examples of how an optical device can be coupled to and decoupled from the body of an adjustable light fixture. Other examples of coupling features can include, but are not limited to, detents, compression fittings, rotating clips, and spring clips.

In one or more example embodiments, example adjustable light fixtures allow for increased tilt and rotational range of motion of the body relative to the housing, while maintaining the environmental isolation required by applicable standards and regulations for such light fixtures. Adjustments to the example light fixtures can be made by a user without the use of tools. Further, the configuration (e.g., the sealing member disposed within the cavity formed by the housing) of the example adjustable light fixtures allow the body of the light fixture to be held in any desired position. Using example embodiments described herein can improve customer satisfaction and ease of use.

Accordingly, many modifications and other embodiments set forth herein will come to mind to one skilled in the art to which example embodiments pertain having the benefit of the teachings presented in the foregoing descriptions and the associated drawings. Therefore, it is to be understood that example embodiments are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. An adjustable light fixture comprising:

a housing comprising at least one wall that forms a first cavity, wherein in the housing has a top portion and a bottom end;

a body comprising a first body portion and a second body portion that movably abuts against the first body portion, wherein the body is movably disposed within the first cavity of the housing, wherein the body is configured to have a plurality of positions relative to the housing, wherein the plurality of positions includes the body having a tilt angle relative to the housing; and a resilient device disposed between the first body portion and the second body portion, wherein the resilient device simultaneously pushes the first body portion against the top portion of the housing and the second body portion against the bottom end of the housing when the body is in each of the plurality of positions.

2. The adjustable light fixture of claim 1, wherein the second body portion comprises at least one light source, wherein the at least one light source emits light from the first cavity into the ambient environment when the body is in any of the plurality of positions.

3. The adjustable light fixture of claim 2, wherein an inner surface of the at least one wall of the housing comprises a material that absorbs a portion of the light emitted by the at least one light source when the housing is in a position where the portion of the light emitted by the at least one light source is directed toward the at least one wall rather than directly to the ambient environment.

4. The adjustable light fixture of claim 1, further comprising an optical device coupled to the second body portion, wherein the optical device is disposed between the at least one light source and the ambient environment.

5. The adjustable light fixture of claim 4, wherein the optical device comprises a lens.

6. The adjustable light fixture of claim 4, wherein the optical device is removably coupled to the housing.

7. The adjustable light fixture of claim 1, wherein the adjustable light fixture further comprises a sealing member coupled to the at least one wall and at least partially disposed within the first cavity, wherein the sealing member retains the body in each position of the plurality of positions wherein the sealing member prevents fluids in an ambient environment from traversing therethrough when the body is in each of the plurality of positions.

8. The adjustable light fixture of claim 1, wherein at least one of the plurality of positions comprises the tilt angle of up to 30° in any direction.

9. The adjustable light fixture of claim 1, wherein the adjustable light fixture further comprises a sealing member coupled to the at least one wall and at least partially disposed within the first cavity, wherein the sealing member comprises a gasket disposed within a slot in an inner surface of the at least one wall of the housing.

10. The adjustable light fixture of claim 9, wherein the housing comprises a first housing portion and a second housing portion coupled to the first housing portion, wherein the first sealing member is disposed within the housing portion.

11. The adjustable light fixture of claim 1, wherein the body further comprises a mechanical stop that contacts the housing when the tilt angle of the body relative to the housing reaches a maximum value.

12. The adjustable light fixture of claim 1, wherein the resilient device has disposed therethrough at least one electrical cable for delivering power to at least one light source.

13. The adjustable light fixture of claim 1, wherein the first body portion comprises a first resilient device receiving feature for receiving a first end of the resilient device, and wherein the second body portion comprises a second resilient device receiving feature for receiving a second end of the resilient device.

14. The adjustable light fixture of claim 1, wherein the adjustable light fixture further comprises a sealing member coupled to the at least one wall and at least partially disposed within the first cavity, wherein the sealing member further prevents air from the ambient environment from passing therethrough.

15. The adjustable light fixture of claim 1, wherein the housing further comprises a trim disposed adjacent to an opening of the first cavity.

16. The adjustable light fixture of claim 15, wherein the housing further comprises a sealing member disposed within a channel of the trim, wherein the trim and the sealing member are configured to abut against a first side of a structural element.

17. The adjustable light fixture of claim 16, wherein the housing further comprises at least one securing feature, wherein the at least one securing feature is configured to abut against a second side of the structural element.

18. The adjustable light fixture of claim 17, wherein the at least one securing feature comprises a spring clip.

19. The adjustable light fixture of claim 1, further comprising:

a friction block disposed between the housing and the body, wherein the friction block retains the housing in each position of the plurality of positions.

20. The adjustable light fixture of claim 19, wherein the friction block is disposed adjacent to a sealing member.

* * * * *